US011548689B2

(12) United States Patent
Kodama et al.

(10) Patent No.: US 11,548,689 B2
(45) Date of Patent: Jan. 10, 2023

(54) SHEET MATERIAL CONTAINER

(71) Applicant: KAO CORPORATION, Tokyo (JP)

(72) Inventors: Daisuke Kodama, Sumida-ku (JP); Yoshinori Inagawa, Sumida-ku (JP); Takahiro Otsuka, Sumida-ku (JP); Masahito Chiwaki, Sumida-ku (JP)

(73) Assignee: KAO CORPORATION, Tokyo (JP)

( * ) Notice: Subject to any disclaimer, the term of this patent is extended or adjusted under 35 U.S.C. 154(b) by 0 days.

(21) Appl. No.: 17/649,012

(22) Filed: Jan. 26, 2022

(65) Prior Publication Data

US 2022/0144495 A1 May 12, 2022

Related U.S. Application Data

(63) Continuation of application No. 16/325,858, filed as application No. PCT/JP2017/008931 on Mar. 7, 2017, now Pat. No. 11,261,008.

(51) Int. Cl.

| | |
|---|---|
| ***B65D 33/02*** | (2006.01) |
| ***B65D 75/00*** | (2006.01) |
| ***B65D 75/52*** | (2006.01) |

(52) U.S. Cl.

CPC ..... *B65D 33/02* (2013.01); *B65D 75/008* (2013.01); *B65D 75/52* (2013.01); *B65D 75/525* (2013.01); *B65D 2575/586* (2013.01)

(58) Field of Classification Search

CPC ..... B65D 33/02; B65D 75/008; B65D 75/52; B65D 75/525; B65D 2575/586; B65D 75/20; B65D 75/12; B65D 75/28; B65D 75/30; B65D 75/305; B65D 75/324; B65D 75/328; B65D 75/368

See application file for complete search history.

(56) References Cited

U.S. PATENT DOCUMENTS 9,934,366 B1 * 4/2018 Zanuzoski ..... G16H 20/13
2004/0238550 A1 * 12/2004 Stefandl ..... B65D 77/286 220/712

(Continued)

FOREIGN PATENT DOCUMENTS

CA 2 872 995 A1 11/2013
CN 204341622 U 5/2015

(Continued)

OTHER PUBLICATIONS

International Search Report dated May 16, 2017 in PCT/JP2017/008931 filed Mar. 7, 2017.

(Continued)

*Primary Examiner* — Don M Anderson

(74) *Attorney, Agent, or Firm* — Oblon, McClelland, Maier & Neustadt, L.L.P.

(57) ABSTRACT

A sheet container has, formed in the bottom face of the container body, a non-attached part where the film layers are left partially unattached to each other. An filled part is formed by enclosing a filler between the film layers at the non-attached part. A side part of the filled part is a side bulging part bulging toward the skirt part. The side bulging part presses a pressed part above the lower edge of the skirt part from the inside toward the sideward. The lower edge of the skirt part is disposed inwardly from the pressed part.

1 Claim, 32 Drawing Sheets

(56) References Cited

U.S. PATENT DOCUMENTS

| | | | | |
|---|---|---|---|---|
| 2005/0117818 | A1* | 6/2005 | Brans | B65D 77/06 383/107 |
| 2013/0248540 | A1 | 9/2013 | Darby et al. | |
| 2013/0292287 | A1 | 11/2013 | Stanley et al. | |
| 2014/0248005 | A1 | 9/2014 | David et al. | |
| 2015/0126349 | A1* | 5/2015 | Ishihara | B65D 33/02 493/203 |
| 2016/0176583 | A1* | 6/2016 | Ishihara | B65D 75/008 53/452 |
| 2016/0297591 | A1* | 10/2016 | You | B65D 75/008 |
| 2019/0168941 | A1* | 6/2019 | Otsuka | B65D 65/40 |
| 2020/0207518 | A1* | 7/2020 | Kodama | B65D 75/5883 |
| 2021/0039860 | A1* | 2/2021 | Kuragano | B65D 65/40 |
| 2021/0339929 | A1* | 11/2021 | Otsuka | B32B 7/06 |
| 2021/0354333 | A1* | 11/2021 | Otsuka | B29B 17/0042 |
| 2022/0033161 | A1* | 2/2022 | Shibutani | B32B 7/12 |

FOREIGN PATENT DOCUMENTS

| | | | |
|---|---|---|---|
| CN | 105683060 | A | 6/2016 |
| EP | 2 631 195 | A1 | 8/2013 |
| EP | 2 631 195 | A1 | 8/2013 |
| EP | 3 348 488 | A1 | 7/2018 |
| JP | 7-232744 | A | 9/1995 |
| JP | 2000-109095 | A | 4/2000 |
| JP | 2006-123931 | A | 5/2006 |
| JP | 2015-726 | A | 1/2015 |
| JP | 2015-6891 | A | 1/2015 |
| JP | 2015-520706 | A | 7/2015 |
| JP | 2017-141063 | A | 8/2017 |
| JP | 2018-108842 | A | 7/2018 |
| JP | 2018-108843 | A | 7/2018 |
| JP | 2018-144363 | A | 9/2018 |
| JP | 2018-144856 | A | 9/2018 |
| JP | 2018-144857 | A | 9/2018 |
| JP | 2018-144860 | A | 9/2018 |
| JP | 2018-144885 | A | 9/2018 |
| JP | 2018-144888 | A | 9/2018 |
| TW | I291435 | B | 9/2003 |
| WO | WO 2005/063589 | A1 | 7/2005 |

OTHER PUBLICATIONS

Taiwanese First Office Action dated Sep. 13, 2018 in corresponding Taiwanese Patent Application No. 107107608.

Japanese Office dated May 21, 2019 in Japanese Patent Application No. 2017-148225 (with unedited computer-generated English tranlation), 4 pages.

Extended European Search Report dated Mar. 10, 2020, in Patent Application No. 17900182.1, 7 pages.

* cited by examiner

SHEET MATERIAL CONTAINER

CROSS REFERENCE TO RELATED APPLICATIONS

This application is a continuation of U.S. application Ser. No. 16/325,858, filed Feb. 15, 2019, which is a national phase application of PCT/JP2017/008931, filed Mar. 7, 2017, the entire content and disclosure of each of which are incorporated into the present application.

TECHNICAL FIELD

The present invention relates to a sheet container, a packed article in sheet container, a sheet for container, and a container-forming sheet.

BACKGROUND ART

As a sheet container composed of a sheet member, there has recently been proposed a type in which a non-attached part is partially formed between the layers of the sheet member, and a filler such as air is enclosed in the non-attached part, for the purpose of improving shape retention property or the like (see Patent Document 1, for example).

RELATED ART DOCUMENT

Patent Document 1 JP-A-2015-520706

SUMMARY OF THE INVENTION

Present invention relates to a sheet container which includes a container body that surrounds an accommodating area for accommodating an article, the container body being composed of a sheet member given by lamination of a plurality of film layers, the container body includes a front face, a rear face, and a bottom face, the sheet member includes:

a front face-forming sheet part that forms the front face;

a rear face-forming sheet part that forms the rear face; and a bottom face-forming sheet part that forms the bottom face, at a side edge part of the container body, a side sealed part given by mutual attachment of side edge parts of the front face-forming sheet part and the rear face-forming sheet part, is formed to extend vertically, at the side edge part of the container body below the side sealed part, a front lower sheet tab and a rear lower sheet tab each of which is formed by a part of the sheet member is disposed, a front-rear sealed part given by mutual attachment of side edge parts of the front lower sheet tab and the rear lower sheet tab is formed, and, a skirt part given by integration of the front lower sheet tab and the rear lower sheet tab via the front-rear sealed part is formed, the skirt part being disposed at the side end of a bottom of the container body, an annular non-attached part in which the film layers are left partially unattached to each other is formed in the bottom face, an annular filled part is formed by enclosing a filler between the film layers at the annular non-attached part, a side part of the annular filled part is a side bulging part bulging toward the skirt part, the side bulging part presses a pressed part above the lower edge of the skirt part from the inside toward the sideward, the lower edge of the skirt part being disposed inwardly from the pressed part.

DETAILED DESCRIPTION OF THE INVENTION

Figure 1:
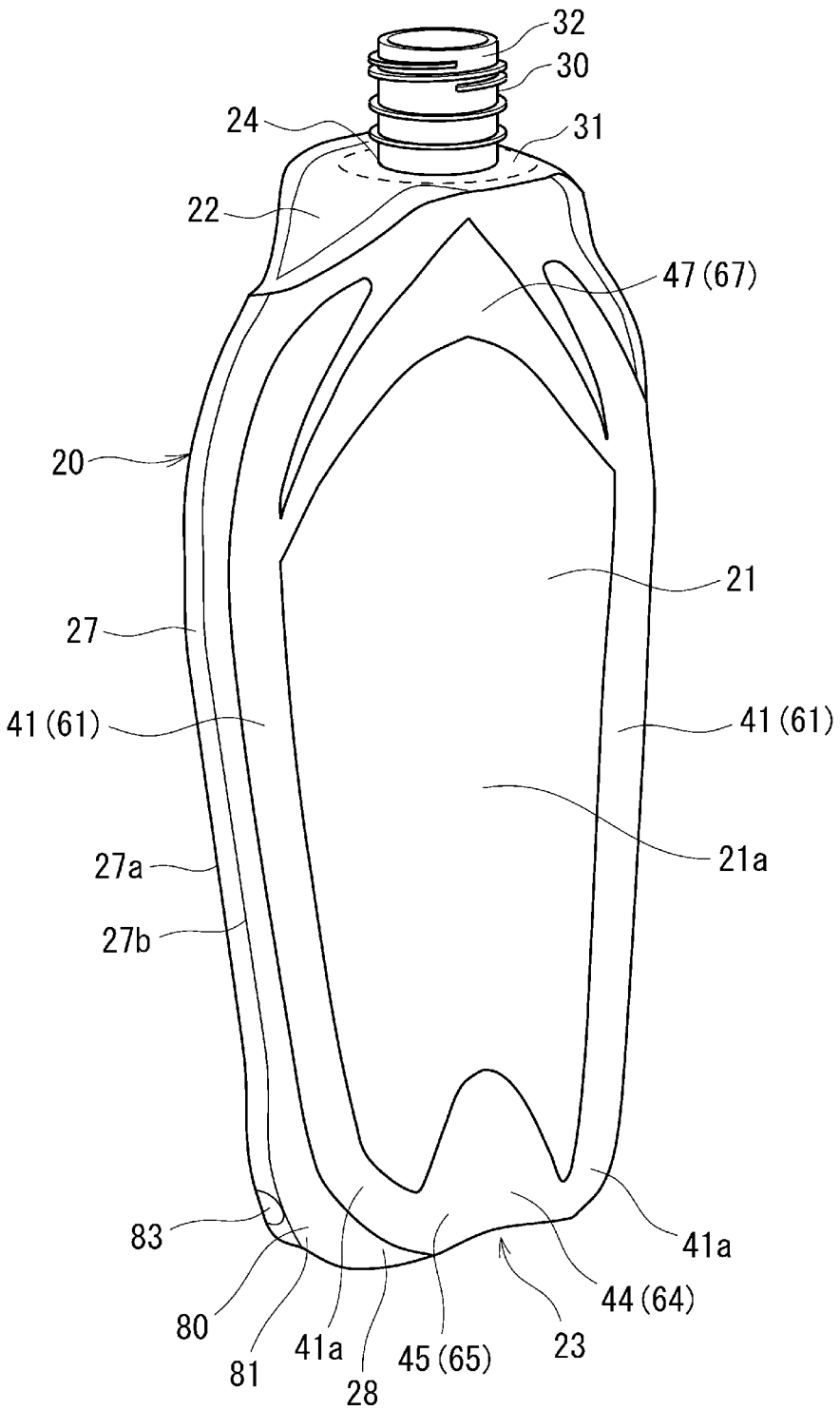
FIG. 1 is a perspective view illustrating a sheet container of a first embodiment.

The type of sheet container having a non-attached part left partially between the layers of the sheet member, and having a filler such as air enclosed in the non-attached part, will consequently have a large total number of layers, and this tends to make a sealed part of the sheet container more stiff. Therefore, there is room for improvement on the feel of touch of the sealed part of the sheet container.

The present invention now relates to a sheet container whose sealed part will have a softer feel of touch, a packed article in sheet container, a sheet for container, and a container-forming sheet.

Preferred embodiments of the present invention will be explained below, referring to attached drawings. In all drawings, all similar constituents will be given the same reference numerals or symbols, so as to suitably avoid repetitive explanation.

First Embodiment

First, a first embodiment will be explained referring to, FIG. 1 to FIG. 16.

Figure 2:
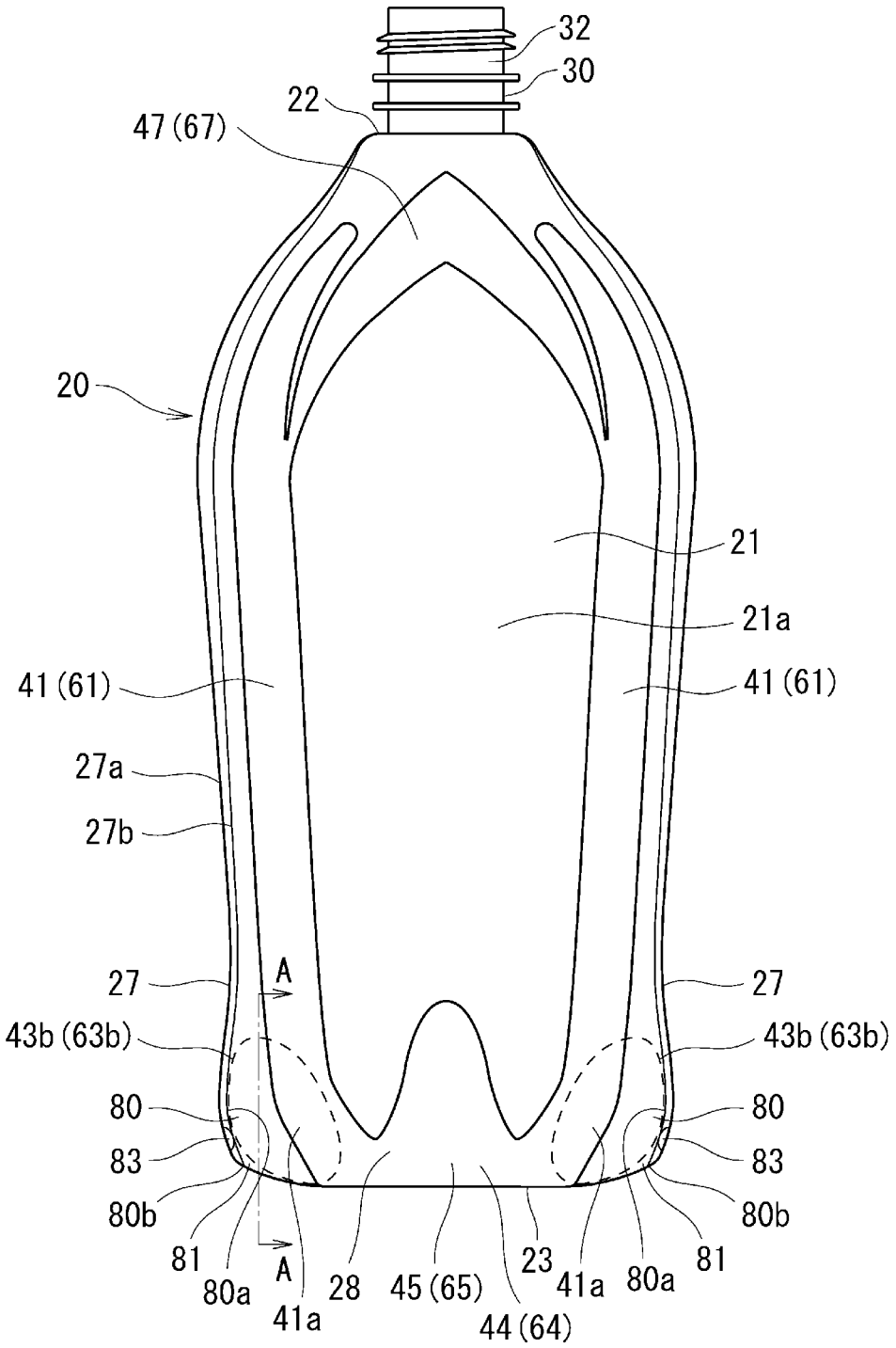
FIG. 2 is a front elevation illustrating the sheet container of the first embodiment.
Figure 3:
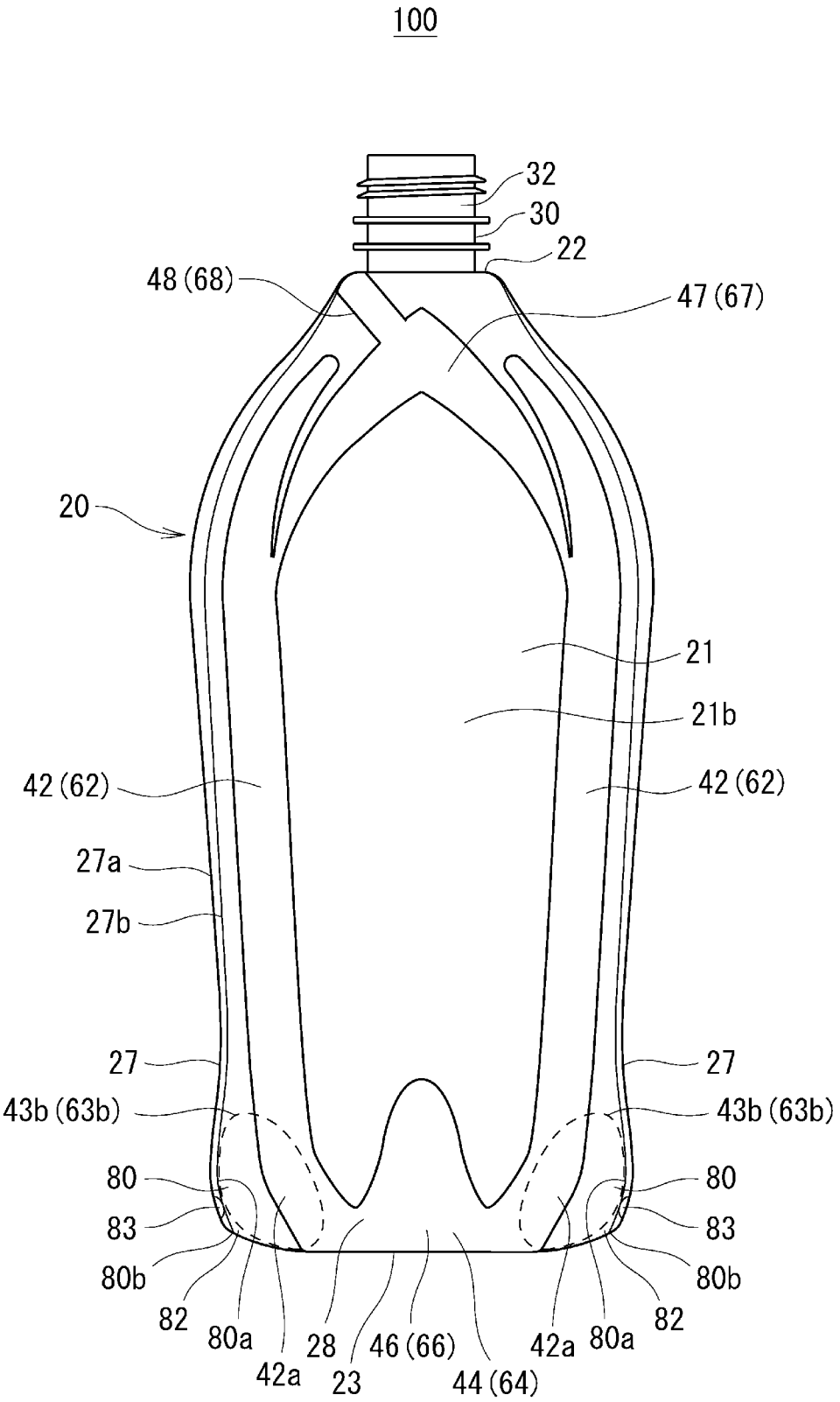
FIG. 3 is a rear view illustrating the sheet container of the first embodiment.
Figure 11:
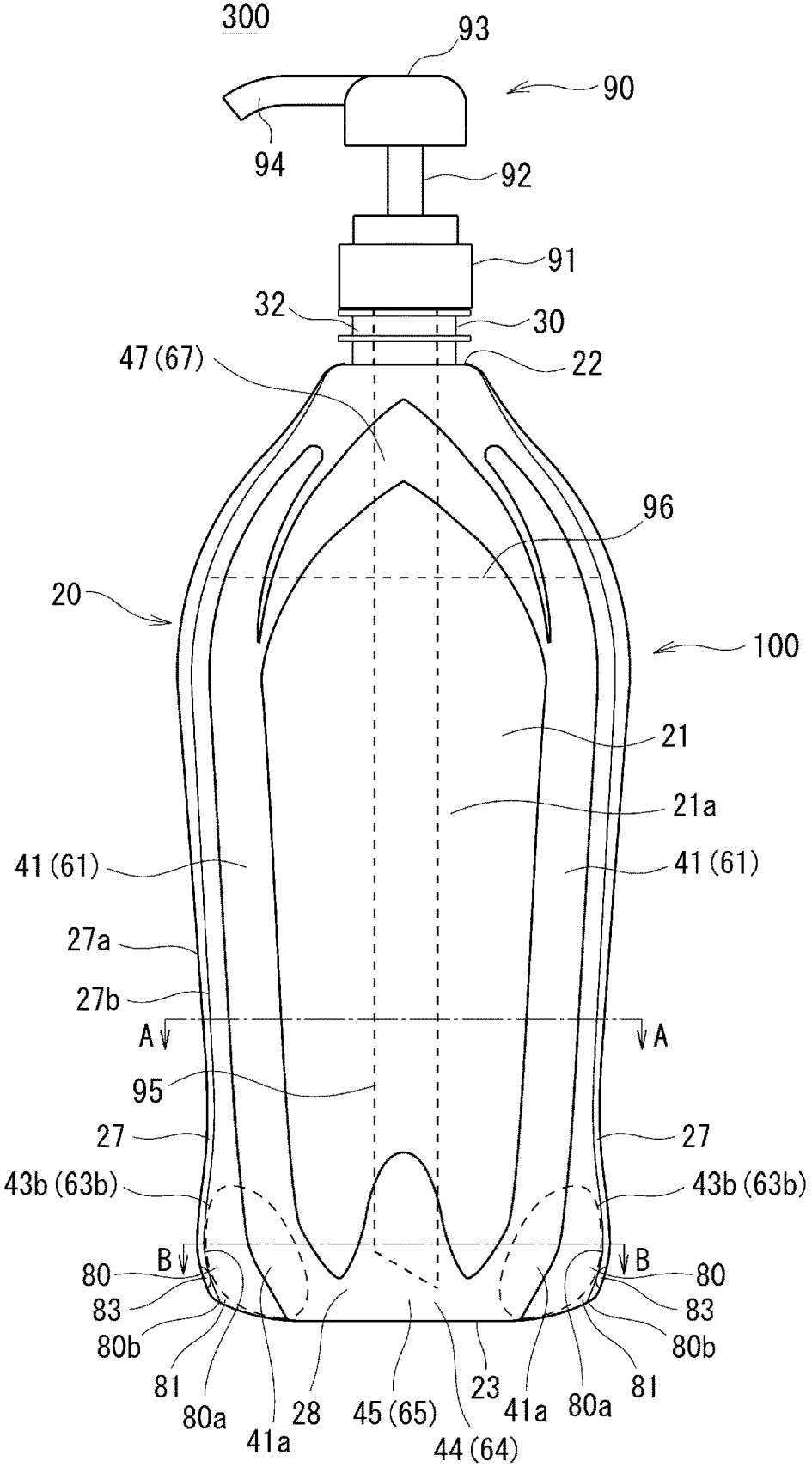
FIG. 11 is a front elevation illustrating a packed article in sheet container of the first embodiment, with a pumping cap attached thereto.
Figure 12:
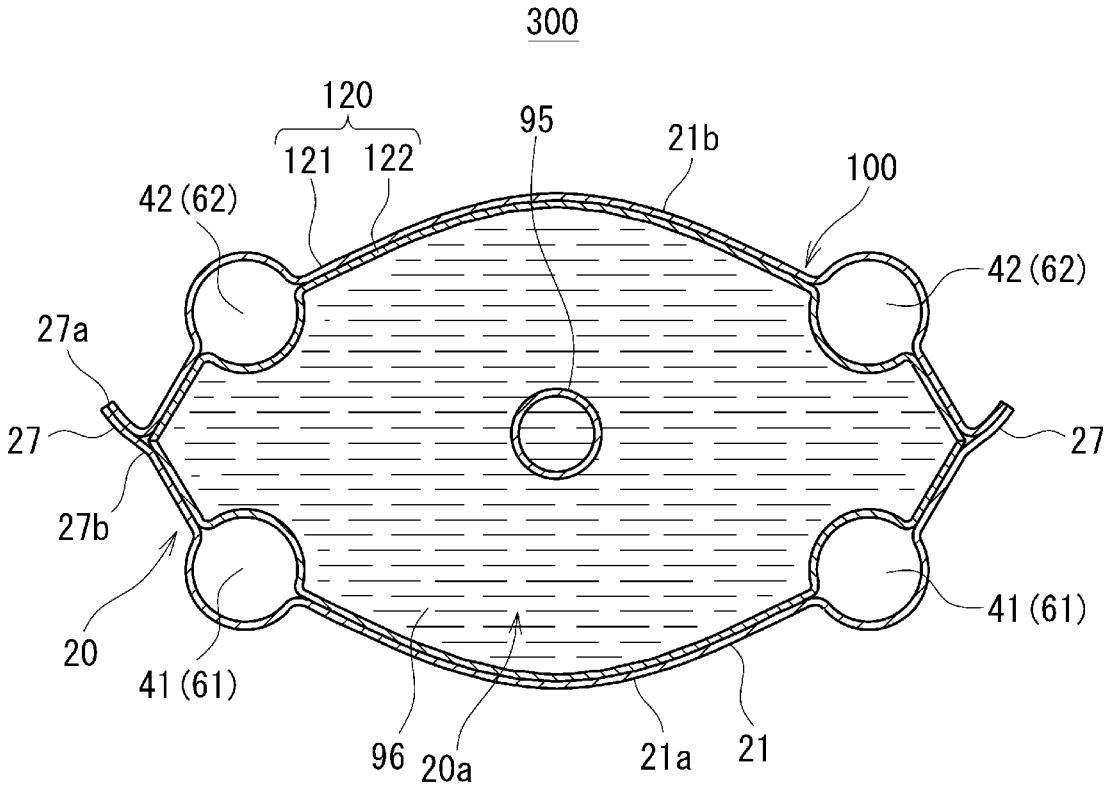
FIG. 12 is a plane cross-sectional view (cross-sectional view taken along line A-A in FIG. 11) illustrating the packed article in sheet container of the first embodiment.
Figure 13:
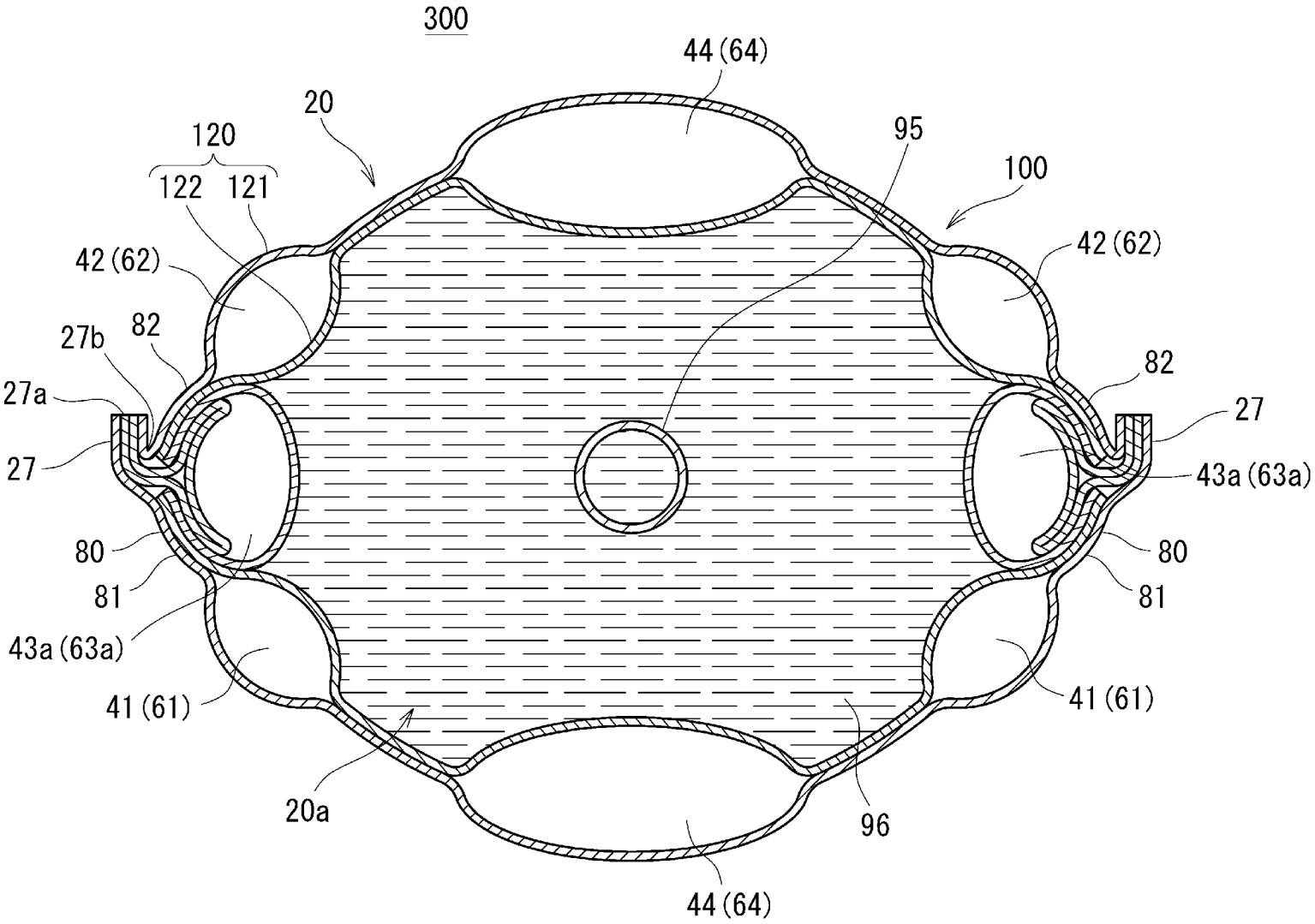
FIG. 13 is a plane cross-sectional view (cross-sectional view taken along line B-B in FIG. 11) illustrating the packed article in sheet container of the first embodiment.

In this embodiment, all explanations on positional relations (vertical relation, etc.) of the individual constituents of a sheet container 100 and a packed article in sheet container 300 (FIG. 11) will be made assuming that the sheet container 100 is kept stand as illustrated in FIG. 2 and FIG. 3, and that a packed article in sheet container 300 is kept stand as illustrated in FIG. 11, unless otherwise specifically stated. However, the positional relations explained here not always coincide with the positional relations when the sheet container 100 and the packed article in sheet container 300 are used or manufactured.

The front face side of the sheet container 100 and the packed article in sheet container 300 will be referred to as "front side" or "front", the rear face side of the sheet container 100 and the packed article in sheet container 300 will be referred to as "rear side" or "rear", the right side of the sheet container 100 and the packed article in sheet container 300 when viewed from the front face (the right hand side in FIG. 2 and FIG. 11) will be referred to as "right", and the left side of the sheet container 100 and the packed article in sheet container 300 when viewed from the front face (the left hand side in FIG. 2 and FIG. 11) will be referred to as "left".

The positional relations of the individual constituents of the sheet container 100 and the packed article in sheet container 300 may occasionally be explained based on the positional relations in the individual drawings.

The sheet container 100 of this embodiment has a container body 20 that surrounds an accommodating area 20*a* (FIG. 12, etc.) for accommodating an article 96.

The container body 20 is composed of a sheet member (container body-forming sheet member 120) given by lamination of a plurality of film layers (for example, two film layers that are a first film layer 121 and a second film layer 122).

The container body 20 has a front face 21*a*, a rear face 21*b*, and a bottom face (bottom gusset 23).

The sheet member (container body-forming sheet member 120) has a front face-forming sheet part 51 that forms the front face 21*a*, a rear face-forming sheet part 52 that forms the rear face 21*b*, and a bottom face-forming sheet part 53 that forms the bottom face (bottom gusset 23).

At a side edge part of the container body 20, a side sealed part 27 given by mutual attachment of side edge parts of the front face-forming sheet part 51 and the rear face-forming sheet part 52, is formed to extend vertically.

At the side edge part of the container body 20 below the side sealed part 27, a front lower sheet tab 81 and a rear lower sheet tab 82 each of which is formed by a part of the sheet member (container body-forming sheet member 120) is disposed, a front-rear sealed part 83 given by mutual attachment of side edge parts of the front lower sheet tab 81 and the rear lower sheet tab 82 is formed, and, a skirt part 80 given by integration of the front lower sheet tab 81 and the rear lower sheet tab 82 via the front-rear sealed part 83 is formed.

The skirt part 80 is disposed at the side end of a bottom 28 of the container body 20.

An annular non-attached part (annular non-attached part 63) in which the film layers are left partially unattached to each other is formed in the bottom face (bottom gusset 23).

An annular filled part (annular filled part 43) is formed by enclosing a filler between the film layers at the annular non-attached part (annular non-attached part 63).

A side part of the annular filled part (annular filled part 43) is a side bulging part 43*b* bulging toward the skirt part 80.

The side bulging part 43*b* presses a pressed part 80*a* (see FIG. 2, FIG. 3, FIG. 14) above the lower edge 80*b* of the skirt part 80 from the inside toward the sideward.

Here, "inside" means the center side of the sheet container 100 with respect to the pressed part 80*a* of the skirt part 80 in the transverse direction (left-right direction in FIG. 2).

The lower edge 80*b* of the skirt part 80 is disposed inwardly from the pressed part 80*a*.

Here, the side bulging part 43*b* preferably bulges at least upward. In this embodiment, the side bulging part 43*b* bulges sideward and upward.

According to the sheet container 100 of this configuration, it now becomes possible to suitably provide a structure with at least a part of the side sealed part 27 left fallen frontward or rearward.

Figure 5A:
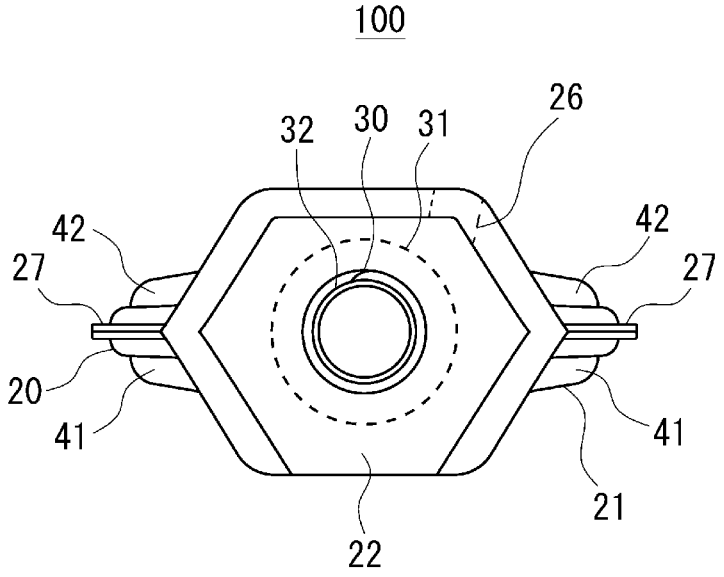
FIG. 5(*a*) is a plan view illustrating the sheet container of the first embodiment, and FIG. 5(*b*) is a bottom view illustrating the sheet container of the first embodiment.
Figure 5B:
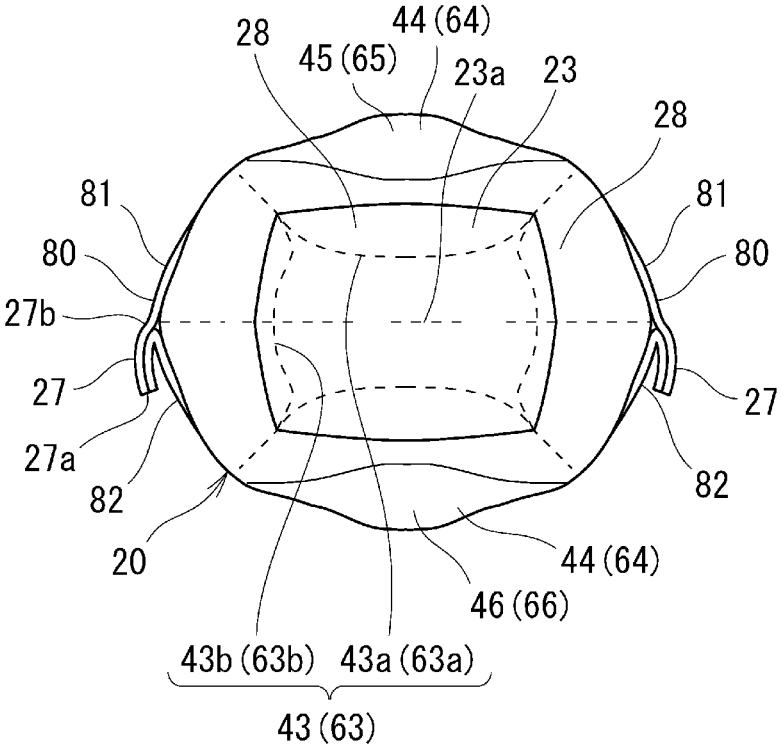

Here, "the side sealed part 27 left fallen" means that the side sealed part 27 is kept inclined from the laterally projected state, and more preferably means that the outer edge (side 27*a* in FIG. 17) of the side sealed part 27 is kept closer to, or in contact with the side edge part of the trunk 21 of the container body 20 (see FIG. 5(*b*), for example).

With at least a part of the side sealed part 27 left fallen frontward or rearward, the side sealed part 27 can provide a soft touch to the user who holds the trunk 21.

The present inventor contemplates a mechanism of fall of the side sealed part 27 frontward or rearward as follows.

Figure 17:
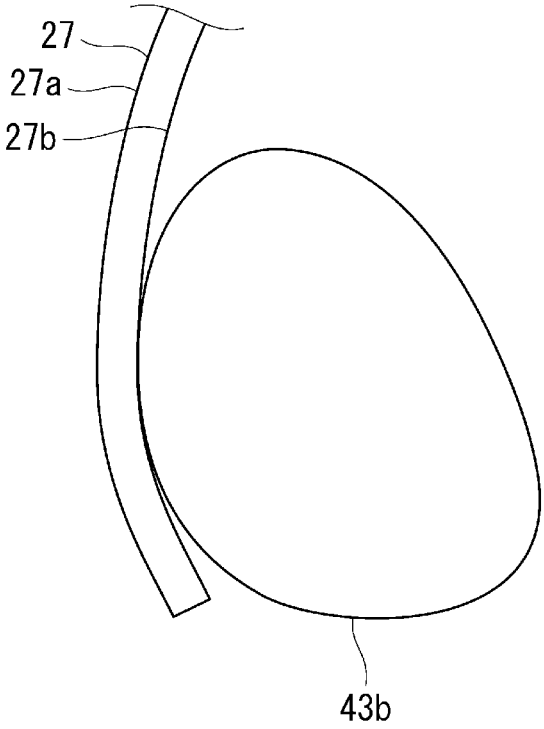
FIG. 17 is a drawing (schematic drawing) explaining a mechanism of fall of a side sealed part.

FIG. 17 is a schematic drawing illustrating the side bulging part 43*b* and the side sealed part 27 of one side, when the sheet container 100 is viewed from the front face side.

At least a part of the side sealed part 27 is bent due to the influence of the pressing of the skirt part 80 by the side bulging part 43*b*.

Here, as illustrated in FIG. 17, in at least a part of the side sealed part 27, a side 27*b* of the base side of the side sealed part 27 will be longer than a side 27*a* on the opposite side. However, the length of side 27*a* and the length of side 27*b* are equal in their natural state, so that the side sealed part 27 manages to restore its stable state where the side 27*a* and the side 27*b* have the same length. As a consequence, at least a part of the side sealed part 27 is considered to fall frontward or rearward (see FIG. 4, FIG. 5(*b*), FIG. 12, FIG. 13, etc.).

Also a neighboring part of the side sealed part 27, affected by the part fallen as a result of equalizing the length of side 27*a* and the length of side 27*b*, is considered that the side sealed part 27.

The filler may be fluid (gas or liquid), solid (for example, particulate, resin pellet, etc.) or semi-solid (for example, foam material, etc.), and is preferably a gas such as air.

In this embodiment, the skirt part 80 is disposed at each of the left end and the right end of the bottom 28 of the container body 20.

Each of the left and right sides of the annular non-attached part 63 forms the side bulging part 43*b*.

The left side bulging part 43*b* presses the pressed part 80*a* of the left skirt part 80 from inside towards the left.

The right side bulging part 43*b* presses the pressed part 80*a* of the right skirt part 80 from inside towards the right.

The lower edge 80*b* of the left skirt part 80 is disposed on the right side of the pressed part 80*a* of the left skirt part 80. This is because the pressed part 80*a* of the left skirt part 80 and its peripheral part are pressed by the left side bulging part 43*b* and bulge leftward, whereas the lower edge 80*b* of the left skirt part 80 is not pressed by the side bulging part 43*b*.

Meanwhile, the lower edge 80*b* of the right skirt part 80 is disposed on the left side of the pressed part 80*a* of the right skirt part 80. This is because the pressed part 80*a* of the right skirt part 80 and its peripheral part are pressed by the right side bulging part 43*b* and bulge rightward, whereas the lower edge 80*b* of the right skirt part 80 is not pressed by the side bulging part 43*b*.

The pressed part 80*a* and its peripheral part in the skirt part 80 are pressed by the side bulging part 43*b* and bulged, whereby the skirt part 80 is bent.

Figure 4:
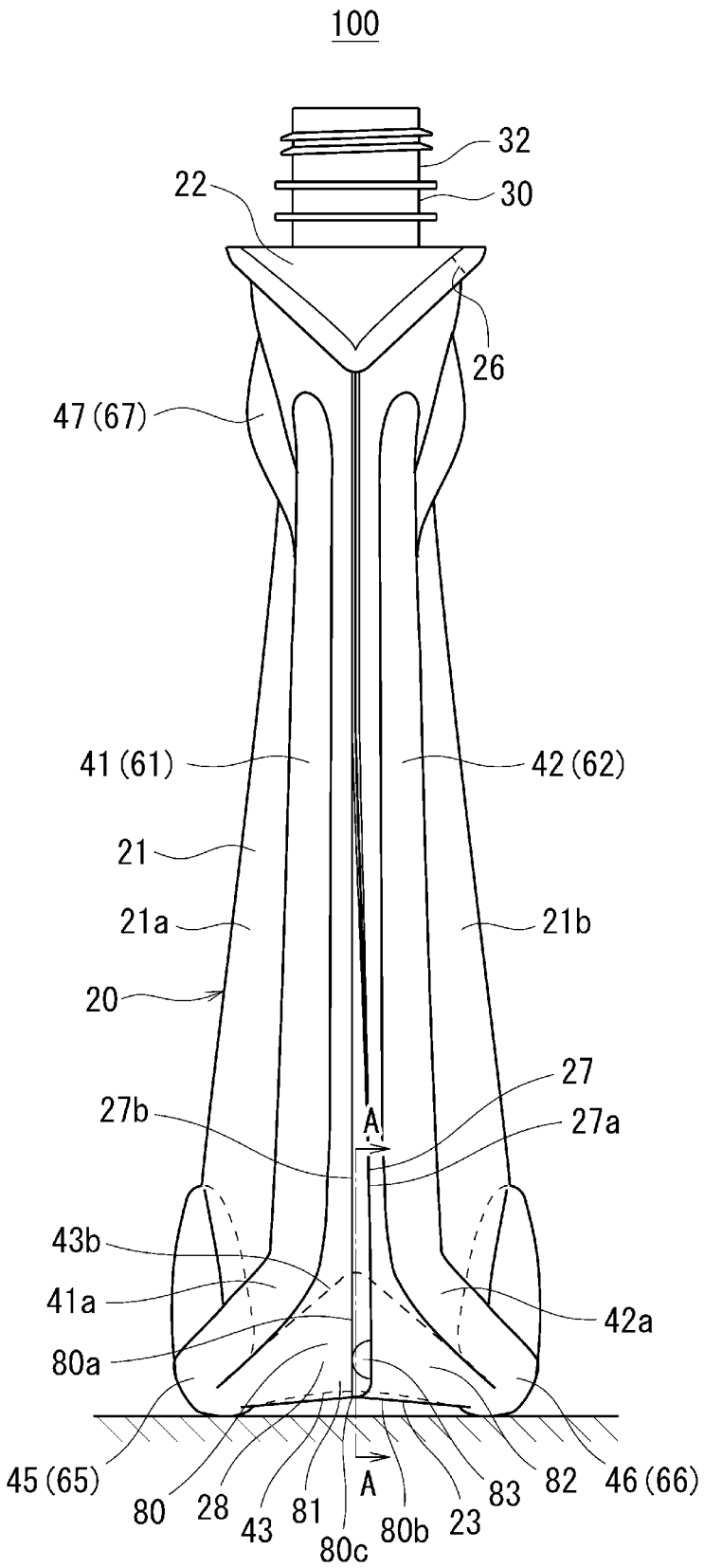
FIG. 4 is a right side elevation illustrating the sheet container of the first embodiment.

Hence in this embodiment, as illustrated in FIG. 4, the lower end part of the skirt part 80 at the central part 80*c* of the skirt part 80 in the front-rear direction of the container body 20 is positioned above the bottom face (bottom gusset 23).

Thereby, the sheet container 100 can be more stably self-standing.

In more details, the lower end part of the central part 80*c* is positioned above a part of the bottom gusset 23 brought into contact with a placement face.

In this embodiment, at least a part of the front-rear sealed part 83 is disposed below the pressed part 80*a* of the skirt part 80.

Accordingly, it is possible to suppress the lower edge 80*b* of the skirt part 80 from extending in the front-rear direction due to the pressed part 80*a* of the skirt part 80 is pressed by the side bulging part 43*b*. Therefore, it is possible to provide a configuration having the lower edge 80*b* of the skirt part 80 disposed inwardly from the pressed part 80*a*, in a more reliable manner.

In this embodiment, the front lower sheet tab 81 and the rear lower sheet tab 82 are locally attached in the front-rear sealed part 83. That is, the front-rear sealed part 83 is a so-called point seal.

This makes it more easy to apply high pressure to the front-rear sealed part 83 when the sheet container 100 is manufactured, and to achieve a sufficient level of attaching strength between the front lower sheet tab 81 and the rear lower sheet tab 82 in the front-rear sealed part 83.

Figure 14:
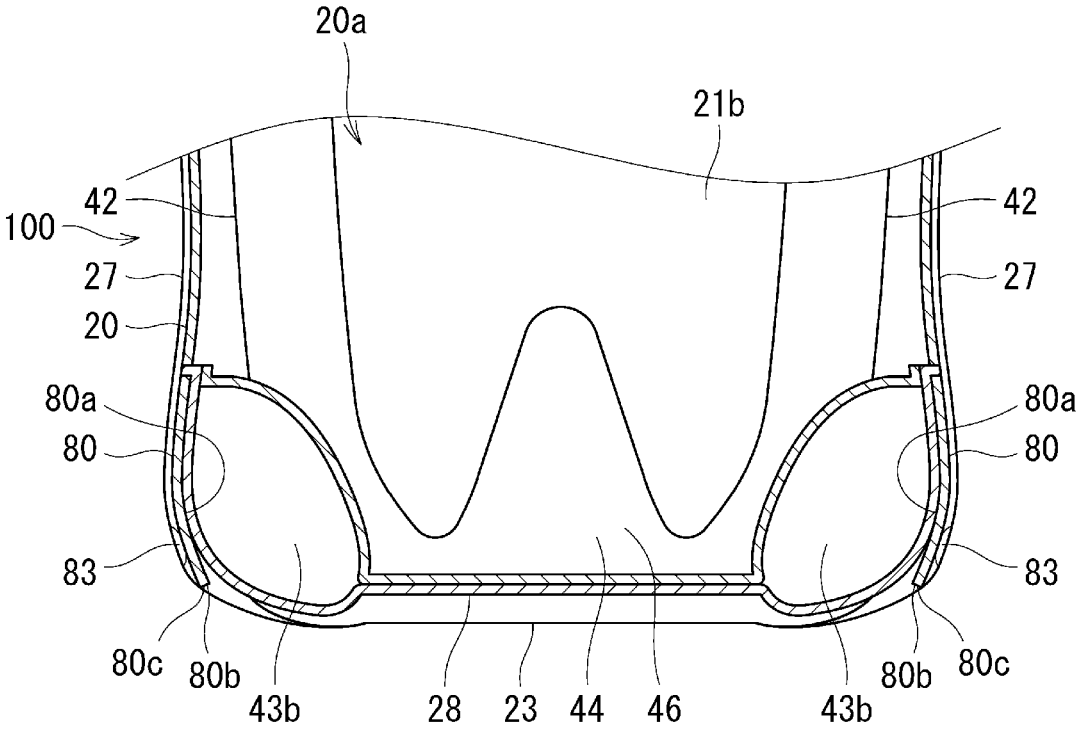
FIG. 14 is a frontal cross-sectional view (cross-sectional view taken along line A-A in FIG. 4) illustrating a lower part of the sheet container of the first embodiment.

Here, for example, as illustrated in FIG. 14, the front-rear sealed part 83 is preferably disposed below a part of the skirt part 80 that bulges most largely to the side. With this configuration, the lower edge 80*b* of the skirt part 80 can be disposed inwardly from the pressed part 80*a*, in a more reliable manner.

Here, bulging of the bottom 28 of the container body 20 in the front-rear direction is moderately suppressed by the front-rear sealed part 83. This successfully suppresses the bottom gusset 23 from bulging convex downward, and makes the sheet container 100 self-stand in a more stable manner.

Figure 15:
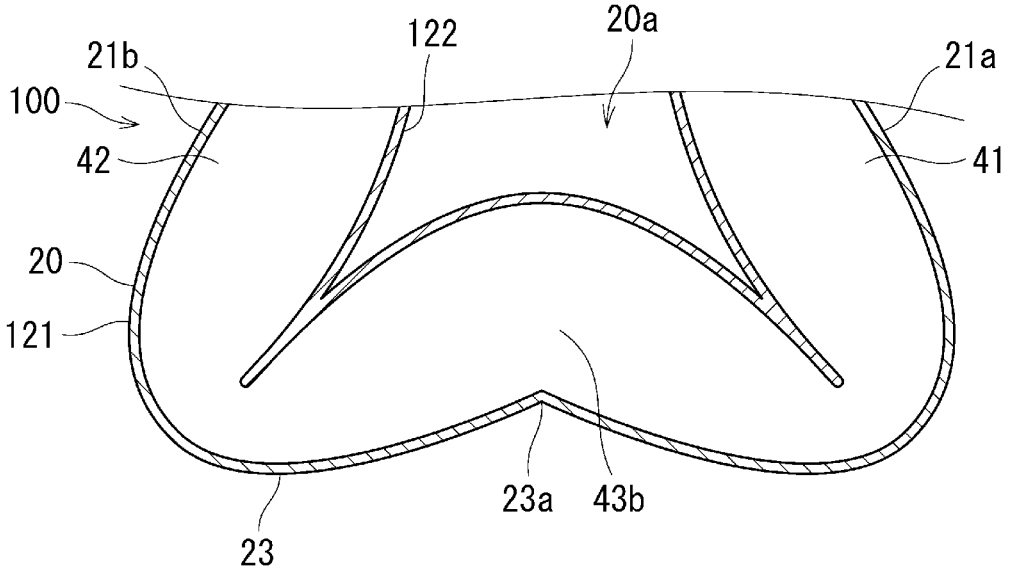
FIG. 15 is a side cross-sectional view (cross-sectional view taken along line A-A in FIG. 2) illustrating the lower part of the sheet container of the first embodiment.

For example, as illustrated in FIG. 15 and FIG. 5(*b*), the bottom gusset 23 has a raised part 23*a* with an upwardly convex shape.

Figure 16:
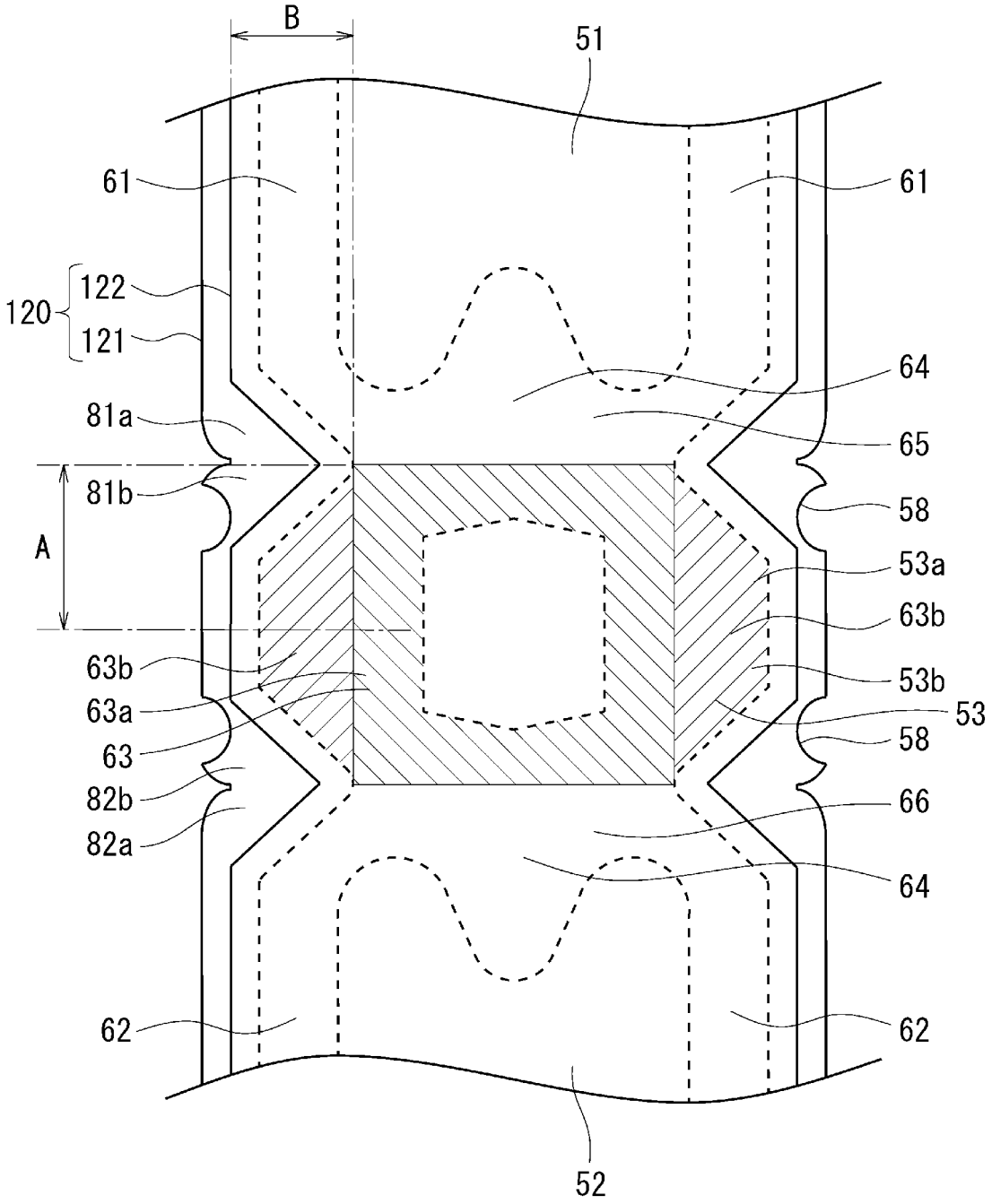
FIG. 16 is a partial enlarged view of FIG. 7 (*a*).

Length "A" in FIG. 16 corresponds to half length of the bottom gusset 23 in the front-rear direction of the sheet container 100. Meanwhile, length "B" in FIG. 16 corresponds to the length of the skirt part 80 in the vertical direction of the sheet container 100.

With length "A" and length "B" equally preset, the degree of bulging of the bottom 28 in the font-rear direction may be sufficient but may be moderately suppressed. For example, by limiting length "B" within ±50% of length "A", more preferably within ±20% of length "A", and even more preferably within ±10% of length "A", this level of bulging may be achieved.

As illustrated in FIG. 11, the packed article in sheet container 300 of this embodiment has the sheet container 100 of this embodiment, and the article 96 accommodated in the accommodating area 20*a*.

In this embodiment, the container body 20 demarcates the accommodating area 20*a*. Hence, when the article 96 is accommodated in the accommodating area 20*a*, the article 96 is brought into direct contact with the inner surface of the container body 20.

However, the present invention is not limited to such example. As described later in a second embodiment, the sheet container 100 may have an inner container 10 covered with the container body 20, and the accommodating area (accommodating area 10*a*) may be demarcated by the inner container 10. In this design, as described later in the second embodiment, the article 96 accommodated in the accommodating area 10*a* is brought into direct contact with the inner surface of the inner container 10, but is not brought into direct contact with the inner surface of the container body 20.

Types of the article 96 are not specifically limited. The article 96 is exemplified by shampoo, hair rinse, body soap, detergent, softener, beverage and food.

The article 96 may be liquid (including paste), or may be solid (for example, particle (including granule), or powder). However, the sheet container 100 in this embodiment is used with a pumping cap 90 (FIG. 11) attached thereto, and the article 96 is liquid.

When the article 96 is liquid, the article 96 preferably has a viscosity, for example at 30° C., equal to or larger than 1 mPa·s and equal to or smaller than 120,000 mPa·s (measured using a B-type viscometer, such as Viscometer TV-10 or Viscometer TVB-10 from Toki Sangyo Co., Ltd.), which is more preferably equal to or larger than 1 mPa·s and equal to or smaller than 60,000 mPa·s.

In this embodiment, all of non-attached parts of the container body 20 (for example, first peripheral non-attached part 61, second peripheral non-attached part 62, annular non-attached part 63, lower transverse direction non-attached part 64, upper transverse direction non-attached part 67 and non-attached part 68) are formed in a merged manner.

Also all of filled parts of the container body 20 (for example, first peripheral filled part 41, second peripheral filled part 42, annular filled part 43, lower transverse direction filled part 44, upper transverse direction filled part 47 and filled part 48) are formed in a merged manner.

However, in the present invention, the container body 20 may have a plurality of non-attached parts independent of each other, and may have a plurality of filled parts independent of each other.

In an area that surrounds the periphery of the non-attached part of the container body 20 (that is, an area that surrounds the periphery of the filled part), a plurality of film layers of the container body-forming sheet member 120 (for example, first film layer 121 and second film layer 122) are attached to each other, and the leakage of the filler from filled part is restricted.

An area where a plurality of film layers of the container body-forming sheet member 120 (for example, first film layer 121 and second film layer 122) are attached to each other may occasionally be referred to as "film area".

Besides the filled part and the film area, the container body-forming sheet member 120 may have an area where a plurality of film layers (for example, first film layer 121 and second film layer 122) are left unattached to each other, and there is no filler interposed between such plurality of film layers.

Figure 7B:
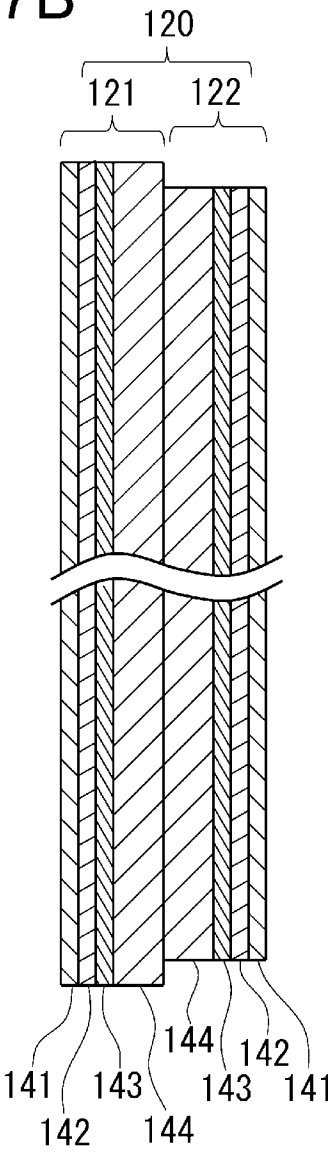
FIG. 7(*a*) is a plan view illustrating the sheet member (container body-forming sheet member) that composes the container body of the sheet container of the first embodiment, and FIG. 7(*b*) is a cross-sectional view illustrating the sheet member that composes the container body of the sheet container of the first embodiment.
Figure 7A:
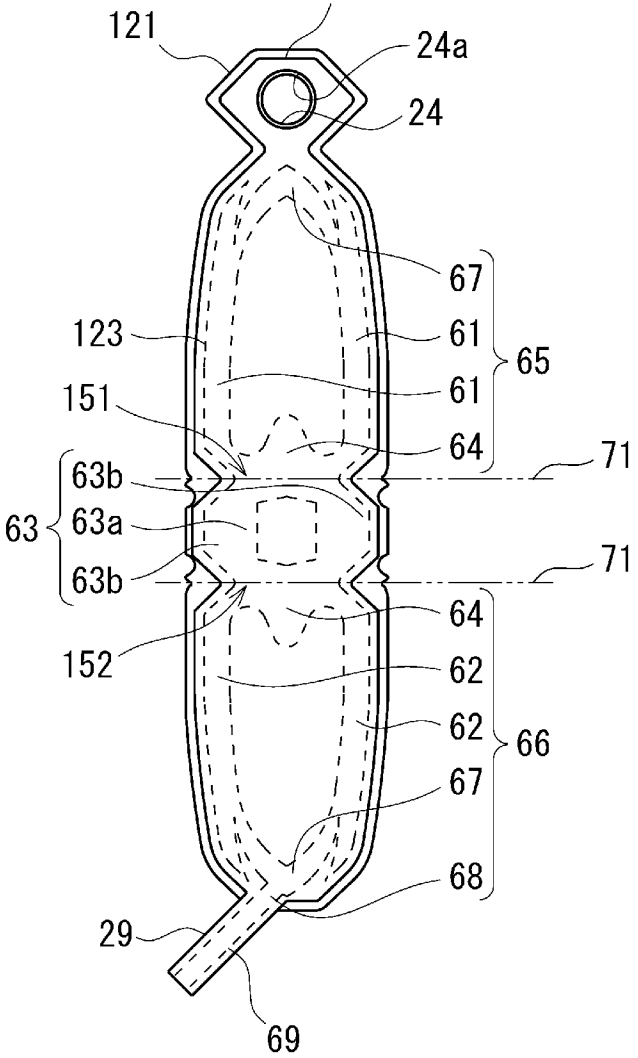
Figure 8:
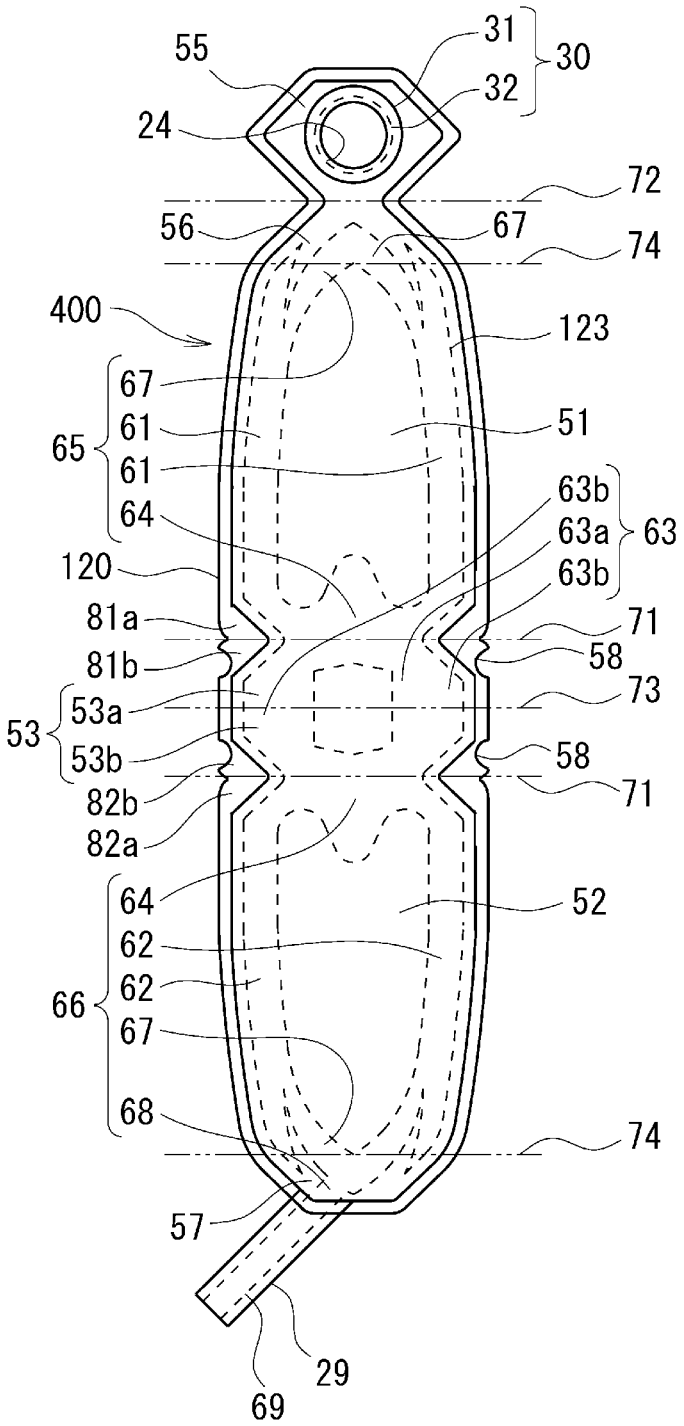
FIG. 8 is a plan view illustrating the container-forming sheet that composes the sheet container of the first embodiment, with a portion later formed into an accommodating area for accommodating an article directed to the top.

The container body 20 is formed into the shape as illustrated in FIG. 1 to FIG. 5(*b*), by folding the container body-forming sheet member 120 shown in FIG. 7(*a*) and FIG. 8, by attaching the circumferential parts of the container body-forming sheet member 120 to each other, and by enclosing the filler such as air into the non-attached part of the container body-forming sheet member 120 (the first peripheral non-attached part 61, the second peripheral non-attached part 62, the annular non-attached part 63, the lower transverse direction non-attached part 64, the upper transverse direction non-attached part 67 and non-attached part 68).

The mutual attaching of the parts of the container body-forming sheet member 120 is performed by heat sealing. The attached part of the circumferential parts of the container body-forming sheet member 120 will be referred to as "container body sealed part", hereinafter. The container body sealed part includes the above-described side sealed part 27.

As illustrated in any one of FIG. 1 to FIG. 5(*b*), the container body 20 has a top gusset 22 which is a gusset formed at the top end of the container body 20, a bottom gusset 23 (bottom face) which is formed at the bottom of the container body 20, and a trunk 21 which is a portion between the top gusset 22 and the bottom gusset 23 in the container body 20.

The top gusset 22 has an opening 24 (FIG. 1) through which the article 96 in the accommodating area 20*a* may be discharged. As described later, in the top gusset 22, for example, there is provided a cylinder part 32 of a spout 30 so as to extend through the opening 24. Hence, in more details, the article 96 in the accommodating area 20*a* of the container body 20 may be discharged through the spout 30 that extends through the opening 24 of the top gusset 22.

The container body 20 has an inner space tightly closed except for the opening 24.

The trunk 21 has a front face 21*a* and a rear face 21*b* opposed to each other while placing the accommodating area 20*a* therebetween.

The bottom edge part of the front face 21*a* and the front edge part of the bottom gusset 23 are connected to each other, at a lower end part of the container body 20 on its front face side. Similarly, the bottom edge part of the rear face 21*b* and the rear edge part of the bottom gusset 23 are connected to each other, at a lower end part of the container body 20 on its rear face side.

The front face 21*a* and the rear face 21*b* are connected to each other at both lateral side edge parts of the trunk 21.

The top gusset 22 has a central part (in this embodiment, a part where the later-described spout 30 is provided) where the level of height is relatively large in the lateral direction of the container body 20, and parts on both sides thereof which slope down towards the left and right ends of the container body 20. Hence, the container body 20 has a shape of sloping shoulder.

The sheet container 100 can stand in a self-standing manner, when the bottom gusset 23 (bottom face) is placed on a horizontal placement face.

In this embodiment, the container body-forming sheet member 120 has the spout 30 preliminarily formed therein (FIG. 8), before being formed into the container body 20, with the cylinder part 32 of the spout 30 projected out from the opening 24 of the container body 20 (FIG. 1, etc.).

The spout 30 includes a flat plate-like base 31 which is attached to the inner surface side of the container body 20, and the cylinder part 32 that projects in one direction out from the base 31. The cylinder part 32 has a cylindrical form.

The outer circumferential surface of the cylinder part 32 is threaded, hence the cylinder part 32 is given a male thread. The base 31 has a through hole at its central part, and the inner space of the cylinder part 32 communicates with the through hole of the base 31.

The accommodating area 20*a* of the container body 20 can communicate with the outside of the sheet container 100, through the through hole of the base 31 and the inner space of the cylinder part 32 of the spout 30. In this embodiment, the article 96 in the accommodating area 20*a* is discharged to the outside, through the spout 30.

In this embodiment, the base 31 of the spout 30 is fixed by adhesion to the container body-forming sheet member 120, on the surface thereof that composes the inner surface of the container body 20. However, the present invention is not limited to such example. The base 31 may alternatively be disposed between the first film layer 121 and the second film layer 122 that compose the container body 20, and may be fixed by adhesion to at least one of the first film layer 121 and the second film layer 122.

In more details, the spout 30 of the sheet container 100 has attached thereto the pumping cap 90 illustrated in FIG. 11.

The pumping cap 90 has, for example, a cap part 91 that screws with the cylinder part 32 of the spout 30, an upright cylinder 92 that projects upward from the cap part 91, a depressable part 93 that is provided at the top end of the upright cylinder 92 and accepts press down operation by the user, a nozzle 94 that projects nearly horizontally from the depressable part 93, and a liquid feeding tube 95 that communicates with the upright cylinder 92 and projects downward from the cap part 91.

The pumping cap 90, attached to the cylinder part 32 of the spout 30, is designed to discharge the article 96 through the upright cylinder 92 and the nozzle 94 to the outside, when the depressable part 93 is pressed down.

As described above, the container body 20 has an opening 24 through which the article 96 can be discharged, the pumping cap 90 is attached to the edge part of the opening 24 provided to the container body 20 of the sheet container 100, and the pumping cap 90 has an operation part (depressable part 93) that accepts pushing operation, and discharges the article 96 to the outside upon acceptance of the pushing operation by the operation part.

When the depressable part 93 is released from the press-down operation and elevates, the article 96 inside the accommodating area 20*a* is sucked up through the liquid feeding tube 95.

The pumping cap 90 is attachable to and detachable from the cylinder part 32. After the article 96 in the sheet container 100 was fully consumed, the pumping cap 90 may be attached to a new sheet container 100 that contains the article 96 (packed article in sheet container 300), and may be used just like before. That is, while the sheet container 100 that contains the article 96 (packed article in sheet container 300) might be disposable, the pumping cap 90 may be recycled.

In this embodiment, the container body 20 has, for example, the filled parts described below, that is, the first peripheral filled part 41, the second peripheral filled part 42, annular filled part 43, the lower transverse direction filled part 44, the upper transverse direction filled part 47 and the filled part 48.

The front filled part 45 is an aggregate of the filled parts disposed on the front face 21*a*, and for example includes a pair of left and right first peripheral filled parts 41, the lower transverse direction filled part 44, and the upper transverse direction filled part 47.

The pair of left and right first peripheral filled parts 41 vertically extend, respectively along a left peripheral part of the front face 21*a* and a right peripheral part of the front face 21*a*.

The lower transverse direction filled part 44 of the front filled part 45 laterally extends at the lower end part of the front face 21*a*, so as to mutually connect the lower end parts of the pair of first peripheral filled parts 41. The lower transverse direction filled part 44 projects upward, for example in the central part in the transverse direction.

The upper transverse direction filled part 47 of the front filled part 45 is disposed in a top part of the front face 21*a*, so as to mutually connect top parts of the pair of first peripheral filled parts 41.

As illustrated in FIG. 2, a lower part 41*a* of the left first peripheral filled part 41 is arranged in an inclined posture, for example so that it shifts rightward as it goes down.

Meanwhile, the lower part 41*a* of the right first peripheral filled part 41 is arranged in an inclined posture, for example so that it shifts leftward as it goes down.

The front filled part 45 is formed, for example, into a shape laterally symmetrical.

The rear filled part 46 is an aggregate of the filled parts disposed on the rear face 21*b*, and includes for example a pair of left and right second peripheral filled parts 42, the lower transverse direction filled part 44, the upper transverse direction filled part 47, and the filled part 48.

The pair of left and right second peripheral filled parts 42 vertically extend, respectively along a left peripheral part of the rear face 21*b* and a right peripheral part of the rear face 21*b*.

The lower transverse direction filled part 44 of the front filled part 46 laterally extends at the lower end part of the rear face 21*b*, so as to mutually connect the lower end parts of the pair of second peripheral filled parts 42. The lower transverse direction filled part 44 projects upward, for example in the central part in the transverse direction.

The upper transverse direction filled part 47 of the rear filled part 46 is disposed at the top of the rear face 21*b*, so as to mutually connect top parts of the pair of second peripheral filled parts 42.

The filled part 48 is, for example, connected to the upper transverse direction filled part 47.

As illustrated in FIG. 3, a lower part 42*a* of the left second peripheral filled part 42 is arranged in an inclined posture, for example, so that it shifts rightward as it goes down, meanwhile, the lower part 42*a* of the right second peripheral filled part 42 is arranged in an inclined posture, for example, so that it shifts leftward as it goes down.

The rear filled part 46, excluding the filled part 48, is for example, formed into a shape laterally symmetrical shape.

The front filled part 45 and a part of the rear filled part 46, excluding the filled part 48, are formed symmetrically in the front-rear direction.

The annular filled part 43 includes, for example, an annular part 43*a* that is annularly disposed along the periphery of the bottom gusset 23, and a pair of side bulging parts 43*b* that individually compose the left and right sides of the annular filled part 43 (see FIG. 5(*b*)).

Here, as illustrated in FIG. 16, the annular non-attached part 63 includes an annular part 63*a*, and a pair of side projected parts 63*b* that laterally project out from the annular part 63*a*. The annular part 63*a* is a part to which a hatching line that descends to the right is given in FIG. 16, meanwhile the side projected parts 63*b* is a part to which a hatching line that ascends to the right is given in FIG. 16.

The annular part 63*a* has, for example, a square frame shape.

Each of the side projected parts 63*b* has, for example, a trapezoidal shape disposed with the upper and lower bases laid vertically, whose width becomes narrower towards the left or right side edge of the container body-forming sheet member 120.

The annular part 43*a* is formed by enclosing the filler into the annular part 63*a*, and the side bulging parts 43*b* are formed by enclosing the filler into the side projected parts 63*b*.

The annular filled part 43 is, for example, formed into a shape laterally symmetrical.

The front filled part 45 communicates, at the lower end part thereof, with the annular filled part 43.

Similarly, the rear filled part 46 communicates, at the lower end part thereof, with the annular filled part 43.

As described above, in this embodiment, all filled parts of the sheet container 100 mutually communicate. At a seal 26 (FIG. 5(*a*)) next to the end of the filled part 48, the filled part is sealed.

Here, an exemplary layer structure of each of the first film layer 121 and the second film layer 122 that compose the container body-forming sheet member 120 will be explained.

Figure 6B:
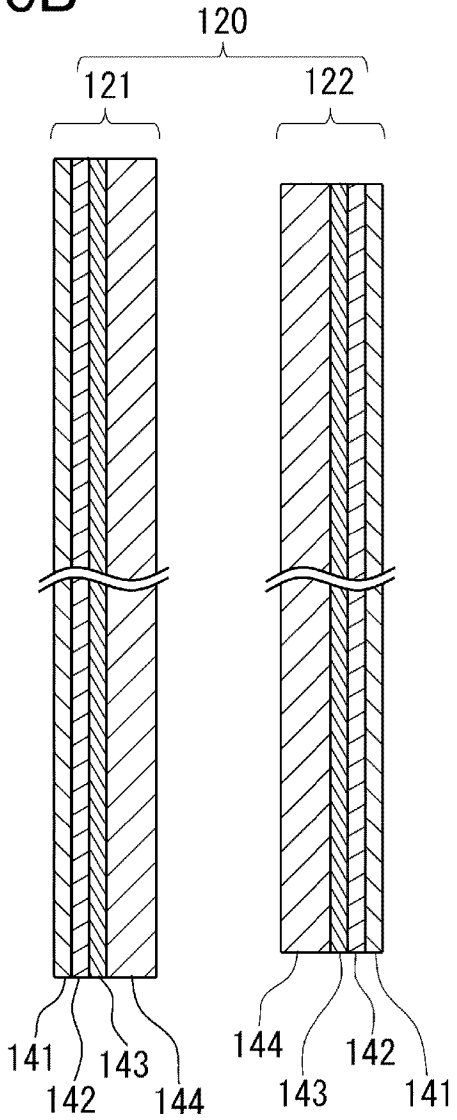
FIG. 6 (*a*) is an exploded view (plan view) illustrating a sheet member (container body-forming sheet member) that composes a container body of the sheet container of the first embodiment, and FIG. 6(*b*) is an exploded view (cross-sectional view) illustrating the sheet member that composes the container body of the sheet container of the first embodiment.
Figure 6A:
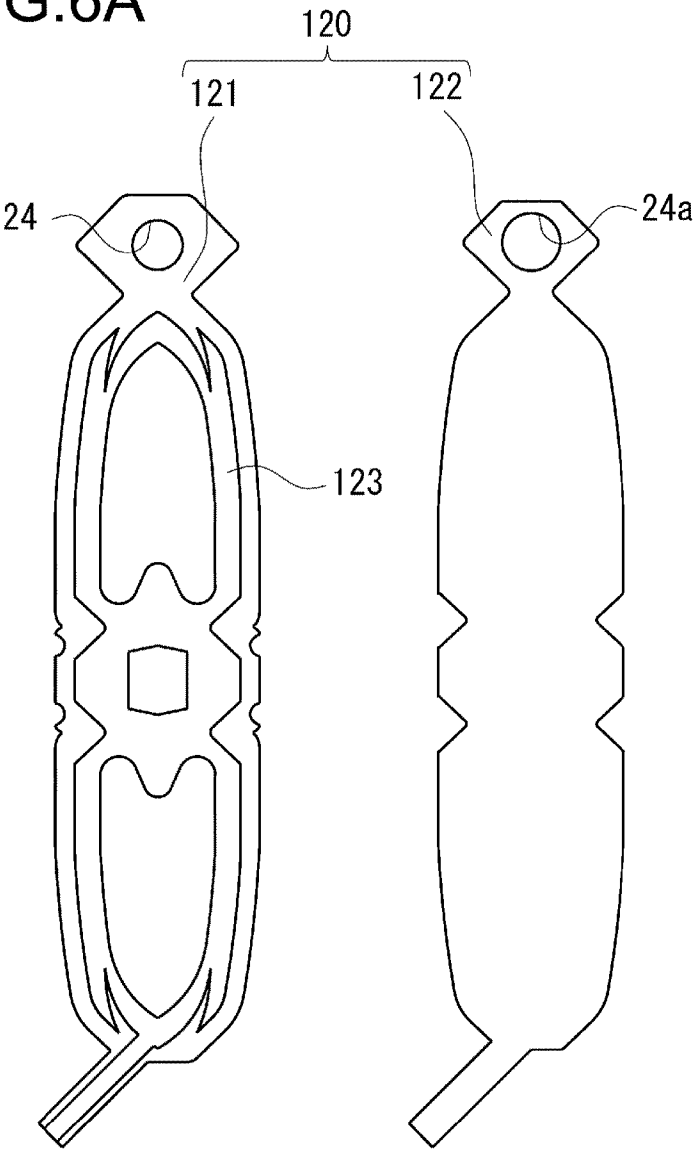

The first film layer 121 is a film layer that composes the outer surface side of the container body 20. As illustrated in FIG. 6(*b*), the first film layer 121 is for example composed of a first layer 141, a second layer 142, a third layer 143, and a fourth layer 144, which are laminated in this order.

The first layer 141 is, for example, made of polyethylene terephthalate (PET) or oriented nylon (ONy).

The second layer 142 is, for example, a transparent evaporated PET layer that is composed of a polyethylene terephthalate film, and silica and alumina vapor-deposited on one surface thereof (the surface on the side of the first layer 141).

The third layer 143 is, for example, composed oriented nylon.

The fourth layer 144 is, for example, composed of linear low-density polyethylene (LLDPE).

While the thickness of these layers is not specifically limited, for example, the first layer 141 may be 12 μm thick, the second layer 142 may be 12 μm thick, the third layer 143 may be 15 μm thick, and the fourth layer 144 may be 40 μm thick.

Major function of the first layer 141 is exemplified by provision of glossiness and printability of the container body 20, as well as provision of rigidity of the container body 20.

Major function of the second layer 142 is exemplified by provision of gas barrier performance.

Major function of the third layer 143 is exemplified by provision of pinhole resistance.

Major function of the fourth layer 144 is exemplified by provision of heat sealability with the second film layer 122, and heat sealability between the parts of the first film layer 121.

The second film layer 122 is a film layer that composes the inner surface side of the container body 20.

The layer structure employable in the second film layer 122 may be same as that in the first film layer 121.

However, materials for composing the first film layer 121 and the second film layer 122 are not limited to those exemplified above.

The second film layer 122 may have a layer structure different from that in the first film layer 121.

For example, a linear low-density polyethylene (LLDPE) layer, same as that composing the fourth layer 144, may be provided as the outermost first layer 141. With such layer structure, the parts of the second film layer 122 may be heat-sealed at the side sealed part 27.

The container body-forming sheet member 120 is formed by laminating and attaching (heat-sealing, for example) the first film layer 121 and the second film layer 122.

That is, the first film layer 121 and the second film layer 122 are laminated, while opposing the fourth layer 144 of the first film layer 121 with the fourth layer 144 of the second film layer 122. By pressurizing and heating the first film layer 121 and the second film layer 122 that are kept laminated as described above, the fourth layer 144 of the first film layer 121 and the fourth layer 144 of the second film layer 122 are mutually heat-sealed. The container body-forming sheet member 120 is formed in this way (see FIG. 7(*a*), FIG. 7(*b*)).

Here, at least one of, or both of, the first film layer 121 and the second film layer 122 have, formed on the surfaces thereof opposed to the other, a non-attached part 123 (FIG. 6(*a*)) having been subjected to non-attaching treatment, making it possible to form a portion between the first film layer 121 and the second film layer 122 (a portion between the fourth layer 144 of the first film layer 121 and the fourth layer 144 of the second film layer 122) left partially unattached, and to form, as illustrated in FIG. 7(*a*), the first peripheral non-attached part 61, the second peripheral non-attached part 62, the annular non-attached part 63, the lower transverse direction non-attached part 64, the upper transverse direction non-attached part 67, the non-attached part 68 and the non-attached part 69. The non-attached part 123 may easily be formed by coating a non-attaching agent (so-called adhesion inhibitor) to a corresponded part and setting it in an adhesion inhibited state. The adhesion inhibitor may freely be selectable from those capable of inhibiting attachment between the first film layer 121 and the second film layer 122. As the adhesion inhibitor, suitably employable are printing inks used for offset printing, flexographic printing, letterpress printing, medium ink, and dedicated adhesion inhibition ink. Also thermosetting or UV-curable ink may suitably be used.

Area of formation of the non-attached part 123 will give the non-attached parts (the first peripheral non-attached part 61, the second peripheral non-attached part 62, annular non-attached part 63, the lower transverse direction non-attached part 64, the upper transverse direction non-attached part 67, the non-attached part 68 and the non-attached part 69).

Of these non-attached parts, the pair of left and right first peripheral non-attached parts 61 formed in the front face-forming sheet part 51 correspond to the pair of left and right first peripheral filled parts 41; the pair of left and right second peripheral non-attached parts 62 formed in the rear face-forming sheet part 52 correspond to the pair of left and right second peripheral filled parts 42; the annular non-attached part 63 formed in the bottom face-forming sheet part 53 corresponds to the annular filled part 43; the lower transverse direction non-attached part 64 formed in the front face-forming sheet part 51 corresponds to the lower transverse direction filled part 44 of the front face-forming sheet part 51; the lower transverse direction non-attached part 64 formed in the rear face-forming sheet part 52 corresponds to the lower transverse direction filled part 44 of the rear face-forming sheet part 52; the upper transverse direction non-attached part 67 formed in the front face-forming sheet part 51 corresponds to the upper transverse direction filled part 47 of the front face-forming sheet part 51; the upper transverse direction non-attached part 67 formed in the rear face-forming sheet part 52 corresponds to the upper transverse direction filled part 47 of the rear face-forming sheet part 52; and the non-attached part 68 formed in the rear face-forming sheet part 52 corresponds to the filled part 48 of the rear face-forming sheet part 52.

An aggregate of the pair of first peripheral non-attached parts 61 formed in the front face-forming sheet part 51, the lower transverse direction non-attached part 64 formed in the front face-forming sheet part 51, and the upper transverse direction non-attached part 67 formed in the front face-forming sheet part 51, will now be referred to as a front non-attached part 65.

Meanwhile, an aggregate of the pair of second peripheral non-attached parts 62 formed in the rear face-forming sheet part 52, the lower transverse direction non-attached part 64 formed in the rear face-forming sheet part 52, and the upper transverse direction non-attached part 67 formed in the rear face-forming sheet part 52, will now be referred to as a rear non-attached part 66.

As illustrated in FIG. 7(*a*), in a state that the container body-forming sheet member 120 is developed in a planar shape, a series of non-attached parts (the aggregate of first peripheral non-attached part 61, the second peripheral non-attached part 62, the annular non-attached part 63, the lower transverse direction non-attached part 64, the upper transverse direction non-attached part 67, the non-attached part 68 and the non-attached part 69) formed in the container body-forming sheet member 120 has a shape in which each of a boundary part 151 between the front non-attached part 65 and the annular non-attached part 63, and a boundary part 152 between the rear non-attached part 66 and the annular non-attached part 63 are constricted.

Here, "the boundary part 151 between the front non-attached part 65 and the annular non-attached part 63" is a part of the non-attached part, laid along one of a later-described pair of folding lines 71 (the upper folding line 71 illustrated in FIG. 7(*a*)); meanwhile the boundary part 152 between the rear non-attached part 66 and the annular non-attached part 63 is apart of the non-attached part, laid along another folding line 71 (the lower folding line illustrated in FIG. 7(*a*)).

Here, "the boundary part 151 and the boundary part 152 of a series of non-attached parts formed in the container body-forming sheet member 120 are constricted" means that the distance between both edges of the series of non-attached part, in the transverse (width) direction, is locally made shorter on the boundary part 151 and the boundary part 152, than in the residual part.

The non-attached part 69 is a part that serves as an introducing part through which the filler is introduced into each of the non-attached parts.

With the filler introduced through the non-attached part 69 and enclosed in each of the non-attached parts, the first film layer 121 and the second film layer 122 are attached to each other on the boundary between the non-attached part 69 and the non-attached part 68, thereby forming the seal 26 (FIG. 5(*a*)), as well as forming each of the filled parts (the first peripheral filled part 41, the second peripheral filled part 42, the annular filled part 43, the lower transverse direction filled part 44, the upper transverse direction filled part 47 and the filled part 48).

Method of forming the non-attached parts (the first peripheral non-attached part 61, the second peripheral non-attached part 62, the annular non-attached part 63, the lower transverse direction non-attached part 64, the upper transverse direction non-attached part 67, the non-attached part 68 and the non-attached part 69) between the first film layer 121 and the second film layer 122 is not limited to the method exemplified above. For example, a die used for heat sealing of the first film layer 121 and the second film layer 122 may have formed therein a recess (groove) in an area corresponded to the non-attached parts. Alternatively, the first film layer 121 and the second film layer 122 may be heat-sealed, while placing therebetween a spacer layer composed of a non-heat sealable material (for example, resin layer such as PET layer).

As illustrated in FIG. 7(*a*), the first film layer 121 is made slightly larger than the second film layer 122, and protrudes around the periphery of the second film layer 122. In other words, as illustrated in FIG. 7 (*b*), in the circumferential part of the container body-forming sheet member 120, the fourth layer 144 of the first film layer 121 exposes.

In a part of the first film layer 121 used for composing the top gusset 22, there is formed the opening 24 through which the cylinder part 32 of the spout 30 is inserted (FIG. 6(*a*)). Meanwhile, in a part of the second film layer 122 used for composing the top gusset 22, there is formed the opening 24*a* which is slightly larger than the opening 24 (FIG. 6(*a*)). Hence, the fourth layer 144 of the first film layer 121 exposes around the circumference of the opening 24, and, inside of the opening 24*a* (see FIG. 7(*a*)).

As illustrated in FIG. 8, a container-forming sheet 400 is formed by providing the spout 30 to the container body-forming sheet member 120.

Here, the base 31 of the spout 30 is fixed to the fourth layer 144 of the first film layer 121 of the container body-forming sheet member 120, at around the opening 24 and to the inner part of the opening 24*a*.

As illustrated in FIG. 8, the container-forming sheet 400 includes the front face-forming sheet part 51, the rear face-forming sheet part 52, the bottom face-forming sheet part 53 and the top gusset sheet part 55, which will be explained in turn below.

The front face-forming sheet part 51 composes the front face 21*a*. The front face-forming sheet part 51 includes a top gusset attaching part 56.

The rear face-forming sheet part 52 composes the rear face 21*b*. The rear face-forming sheet part 52 includes a top gusset attaching part 57.

The bottom face-forming sheet part 53 composes the bottom gusset 23 of the container body 20. The bottom face-forming sheet part 53 includes a front part 53*a* and a rear part 53*b*.

The top gusset sheet part 55 composes the top gusset 22 of the container body 20.

Among them, the top gusset sheet part 55 is formed, for example, into a hexagonal shape (in more detail, a laterally oblong hexagonal shape).

The front face-forming sheet part 51 shares one side with the top gusset sheet part 55, and is connected to the lower side of the top gusset sheet part 55 as shown in FIG. 8.

A part of the front face-forming sheet part 51, located above an area along the folding line 74 illustrated in FIG. 8, is the top gusset attaching part 56. The top gusset attaching part 56 is formed, for example, into a trapezoidal shape with the upper base shorter than the lower base. Meanwhile, a part of the front face-forming sheet part 51, located below an area along the folding line 74, is formed for example in a vertically oblong rectangular shape.

The front part 53*a* and rear part 53*b* of the bottom face-forming sheet part 53 have the same shape.

Each of the front part 53*a* and the rear part 53*b* is formed, for example, into a rectangular shape which is oblong in the transverse direction.

The transverse width of the front part 53*a* and the rear part 53*b* is set equivalent to the transverse width of the lower end part of the front face-forming sheet part 51.

In FIG. 8, the front part 53*a* is connected to the lower side of the front face-forming sheet part 51, meanwhile the rear part 53*b* is connected to the lower side of the front part 53*a*.

In FIG. 8, the rear face-forming sheet part 52 is connected to the lower side of the rear part 53*b*.

A part of the rear face-forming sheet part 52, located below an area along the folding line 74 illustrated in FIG. 8, is the top gusset attaching part 57.

The rear face-forming sheet part 52 is formed into a shape same as the front face-forming sheet part 51.

However, for example, the rear face-forming sheet part 52 is provided integrally with a filler introducing part 29. The filler introducing part 29 has formed therein the non-attached part 69 that reaches the outer edge of the filler introducing part 29. The non-attached part 69 communicates with the non-attached part 68.

In the filler introducing part 29, the first film layer 121 and the second film layer 122 have the same size, so that the first film layer 121 is not protruded around the periphery of the second film layer 122. In short, in the filler introducing part 29, the fourth layer 144 of the first film layer 121 is not exposed.

In FIG. 8, the base 31 of the spout 30 is located on this side of the top gusset sheet part 55, and the cylinder part 32 projects through the top gusset sheet part 55 and comes out therefrom, towards the far side. However, the base 31 may alternatively be disposed between the first film layer 121 and the second film layer 122.

Figure 9:
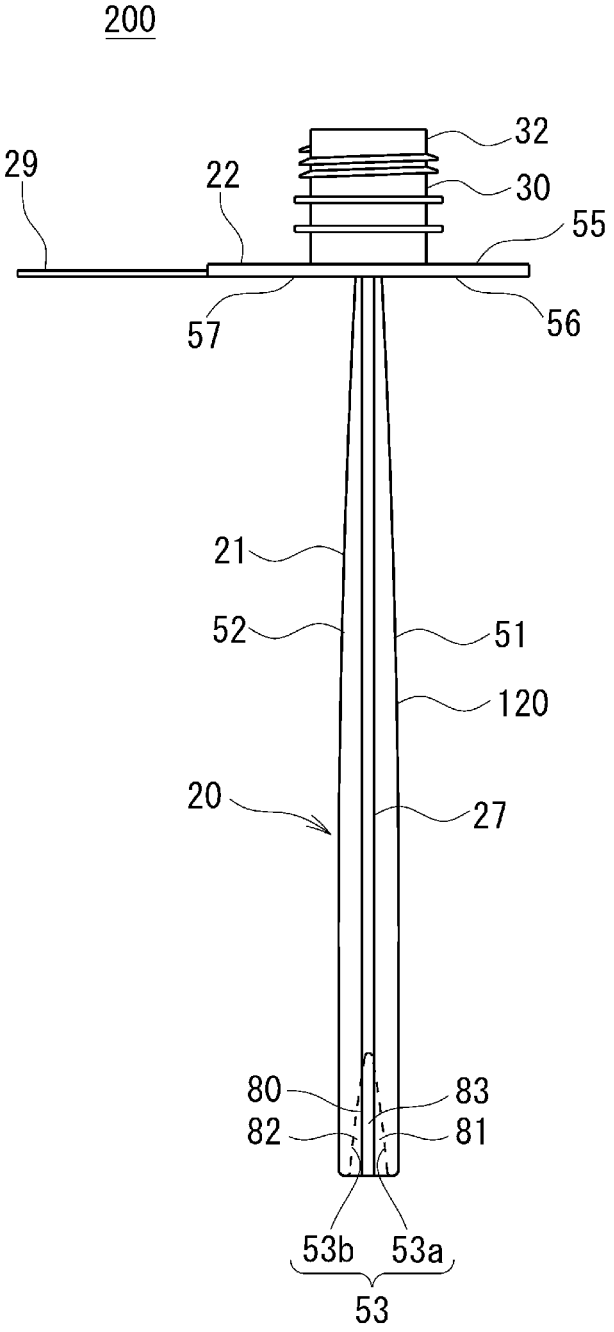
FIG. 9 is a side elevation of a sheet for container of the first embodiment.
Figure 10B:
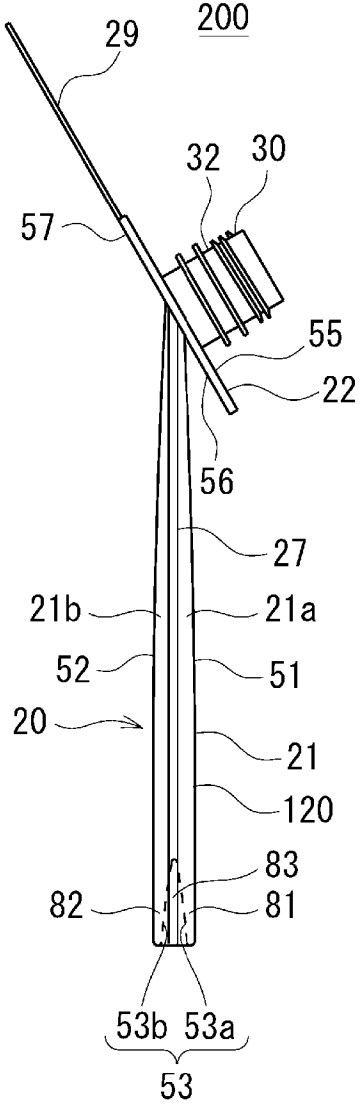
FIG. 10(*a*) is a front elevation illustrating a folded state of the sheet for container of the first embodiment, and FIG. 10(*b*) is a side elevation illustrating a folded state of the sheet for container of the first embodiment.
Figure 10A:
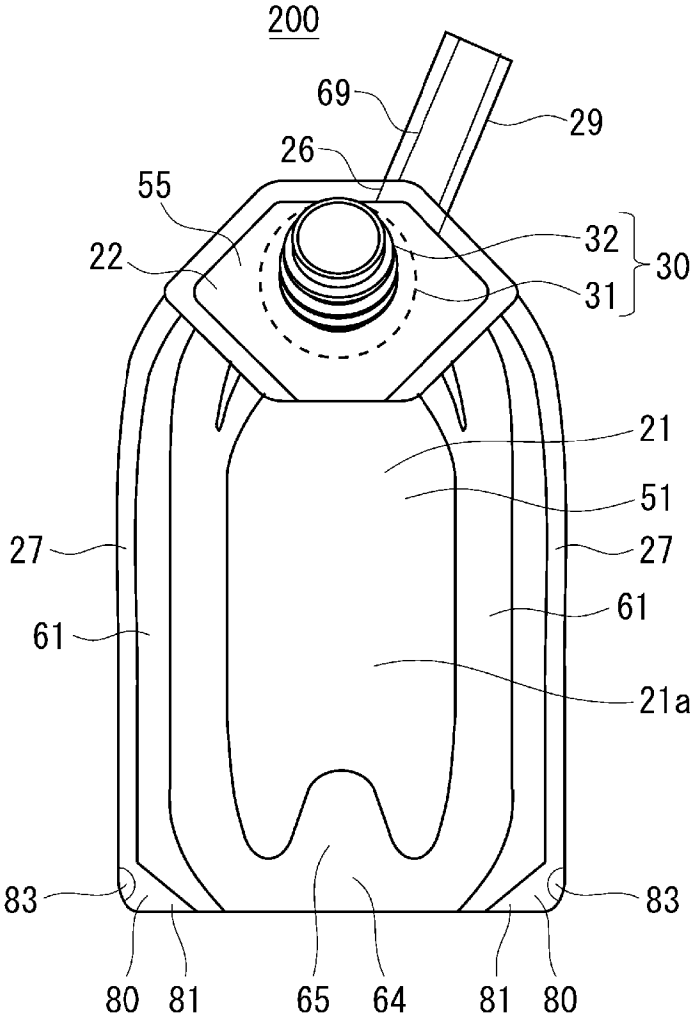

The sheet for container 200 (FIG. 9, FIG. 10(*a*), FIG. 10(*b*)) is formed by folding the container-forming sheet 400, and by attaching (heat-sealing, for example) the circumferential parts of the container body-forming sheet member 120 to each other.

In more details, the container-forming sheet 400 is heat sealed to form the sheet for container 200, while being valley-folded along two folding line 71 and one folding line 72 illustrated in FIG. 8, and mountain-folded at the folding line 73 and two folding lines 74.

The valley folding means a way of folding making the sheet convex towards the far side in FIG. 8, whereas the mountain folding means a way of folding making the sheet convex towards this side in FIG. 8.

One of the two folding lines 71 lies on the boundary between the front face-forming sheet part 51 and the front part 53*a*, and the other lies on the boundary between the rear face-forming sheet part 52 and the rear part 53*b*.

The folding line 72 lies on the boundary between the top gusset sheet part 55 and the front face-forming sheet part 51 (the boundary between the top gusset sheet part 55 and the top gusset attaching part 56).

The folding line 73 lies on the boundary between the front part 53*a* and the rear part 53*b*.

One of the two folding lines 74 lies on the boundary between the top gusset attaching part 56 of the front face-forming sheet part 51 and the other part of the front face-forming sheet part 51, meanwhile, the other one lies on the boundary between the top gusset attaching part 57 of the rear face-forming sheet part 52 and the other part of the rear face-forming sheet part 52.

In the state that the container-forming sheet 400 is folded in this way, a half part of the top gusset sheet part 55 (the lower half as shown in FIG. 8) and the top gusset attaching part 56 overlap with each other; the other part of the top gusset sheet part 55 (the upper half as shown in FIG. 8) and the top gusset attaching part 57 overlap with each other; the front part 53*a* and the rear part 53*b* overlap with each other; the front part 53*a* and the lower end part of the front face-forming sheet part 51 overlap with each other; the rear part 53*b* and the lower end part of the rear face-forming sheet part 52 overlap with each other; and, a part of the front face-forming sheet part 51 excluding the top gusset attaching part 56, and a part of the rear face-forming sheet part 52 excluding the top gusset attaching part 57 overlap with each other.

When the container-forming sheet 400, kept folded in this way, is heat-sealed, the half part of the top gusset sheet part 55 (the lower half as shown in FIG. 8) and the top gusset attaching part 56 are mutually attached; the other part of the top gusset sheet part 55 (the upper half as shown in FIG. 8) and the top gusset attaching part 57 are mutually attached; the front part 53*a* and the lower end part of the front face-forming sheet part 51 are mutually attached; the rear part 53*b* and the lower end part of the rear face-forming sheet part 52 are mutually attached; and, the front face-forming sheet part 51 and the rear face-forming sheet part 52 are mutually attached.

Here, the part attached to the rear face-forming sheet part 52 in the front face-forming sheet part 51 is, the part excluding the top gusset attaching part 56 and a part of the front face-forming sheet part 51 which overlaps the front part 53*a*.

Similarly, the part attached to the front face-forming sheet part 51 in the rear face-forming sheet part 52 is, the part excluding the top gusset attaching part 57 and a part of the rear face-forming sheet part 52 which overlaps the rear part 53*b*.

By heat-sealing the container-forming sheet 400 in this way, the container body sealed parts including the side sealed part 27 will be formed.

Here, outer tabs 81*a*, located at both lateral side edge parts of the front face-forming sheet part 51 adjoining to the front part 53*a*, are heat sealed with inner tabs 81*b*, located at both lateral side edge parts of the front part 53*a* adjoining to the front face-forming sheet part 51, and thereby the front lower sheet tabs 81 (FIG. 2, FIG. 4, FIG. 5(*b*), etc.) are formed.

Meanwhile, outer tabs 82*a*, located at both lateral side edge parts of the rear face-forming sheet part 52 adjoining to the rear part 53*b*, are heat sealed with inner tabs 82*b*, located at both lateral side edge parts of the rear part 53*b* adjoining to the rear face-forming sheet part 52, and thereby the rear lower sheet tabs 82 (FIG. 3, FIG. 4, FIG. 5(*b*), etc.) are formed.

Here, as shown in FIG. 8, on the left and right inner tabs 81*b* of the front part 53*a*, notched parts 58 are formed respectively. That is, notched parts 58 are respectively formed at the left and right sides of the front part 53*a*.

Similarly, also on the left and right inner tabs 82*b* of the rear part 53*b*, notched parts 58 are formed respectively. That is, notched parts 58 are respectively formed at the left and right sides of the rear part 53*b*.

Therefore, in a state in which the container-forming sheet 400 is bent as described above, parts of the outer tabs 81*a* opposed to the individual notched parts 58 will be opposed directly to the outer tabs 82*a*, without interposing the inner tabs 81*b* and the inner tabs 82*b* therebetween.

By locally heat-sealing the outer tab 81*a* and the inner tab 82*b* in parts corresponded to the individual notched parts 58 (that is, by locally heat sealing the front lower sheet tabs 81 and the rear lower sheet tabs 82), the front-rear sealed part 83 will be formed (see FIG. 10(*a*), etc.), and a skirt part 80 where the front lower sheet tab 81 and the rear lower sheet tab 82 are integrated will be formed.

Although the shape of notched part 58 is not specifically limited, it is for example semicircular. Hence, the front-rear sealed part 83 will have a semicircular form, for example.

In this way, the container body-forming sheet member 120 is formed into the container body 20, to give the sheet for container 200 illustrated in FIG. 9, FIG. 10(*a*) and FIG. 10(*b*).

The side sealed part 27 of the sheet for container 200 projects laterally for example, and inclines neither frontwards nor rearwards.

The sheet for container 200 has the tubular filler introducing part 29 that projects out from the container body 20. The non-attached part 69 of the filler introducing part 29 serves as an introducing part through which the filler is introduced into spaces between the first film layer 121 and the second film layer 122, in each of the non-attached parts (the first peripheral non-attached part 61, the second peripheral non-attached part 62, the annular non-attached part 63, the lower transverse direction non-attached part 64, the upper transverse direction non-attached part 67, the non-attached part 68). Location of the filler introducing part 29 is not specifically limited. In this embodiment, for example, the filler introducing part 29 is disposed so that the filler introducing part 29 protrudes from one end of the non-attached part 68.

FIG. 9 illustrates the top gusset 22 laid orthogonally to the trunk 21. When the container-forming sheet 400 is heat-sealed, the sheet will be held as illustrated in FIG. 9, with the half part of the top gusset sheet part 55 and the top gusset attaching part 56 held by dies (not illustrated), with the other part of the top gusset sheet part 55 and the top gusset attaching part 57 held by the dies, and, also with the front face-forming sheet part 51, the rear face-forming sheet part 52, the front part 53*a* and the rear part 53*b* held by the dies.

Heat sealing will be given also to form the front-rear sealed part 83.

FIG. 10 (*a*) and FIG. 10 (*b*) illustrate a state in which the sheet for container 200 is bent so that the top gusset attaching part 56 is overlapped with the other part of the front face-forming sheet part 51. In this embodiment, the sheet for container 200 kept in the thus-bent state is fed from a process for manufacturing the sheet for container 200, to a process for enclosing the filler into each of the non-attached parts.

The filler (air, for example) is then introduced through the non-attached part 69 of the filler introducing part 29, into each of the non-attached parts (the first peripheral non-attached part 61, the second peripheral non-attached part 62, the annular non-attached part 63, the lower transverse direction non-attached part 64, the upper transverse direction non-attached part 67, the non-attached part 68). As a consequence, each of the non-attached parts expand to form each of the filled parts (the first peripheral filled part 41, the second peripheral filled part 42, the annular filled part 43, the lower transverse direction filled part 44, the upper transverse direction filled part 47 and the filled part 48), thereby adding rigidity to the container body 20.

That is, the filler is filled between the first film layer 121 and the second film layer 122 in each of the non-attached parts, and thereby each of the filled parts is formed.

After each of the filled parts (the first peripheral filled part 41, the second peripheral filled part 42, the annular filled part 43, the lower transverse direction filled part 44, the upper transverse direction filled part 47, the filled part 48) are formed, parts of the filled part 48 adjoining to the non-attached part 69 are suitably sealed. In this way, the filler is prevented from leaking from each of the filled parts.

The filler introducing part 29 is then cut at the base.

In this way, the sheet container 100 with a structure described above is manufactured.

As a result of filling of the filler into the annular filled part 43, the side bulging part 43*b* of the annular filled part 43 presses the pressed part 80*a* located above the lower edge 80*b* of the skirt part 80 from inside towards the sideward. This makes the lower edge 80*b* of the skirt part 80 disposed inwardly from the pressed part 80*a*, and also makes at least a part of the side sealed part 27 left fallen frontward or rearward.

As described in the above, the sheet for container 200 has the container body 20 that surrounds the accommodating area 20*a* for accommodating the article 96, the container body 20 is composed of a sheet member given by lamination of a plurality of film layers (container body-forming sheet member 120), the sheet member includes the front face-forming sheet part 51 that forms the front face 21*a* of the container body 20; the rear face-forming sheet part 52 that forms the rear face 21*b* of the container body 20; and the bottom face-forming sheet part 53 that forms the bottom face (bottom gusset 23) of the container body 10.

At the side edge part of the container body 20, the side sealed part 27 given by mutual attachment of side edge parts of the front face-forming sheet part 51 and the rear face-forming sheet part 52, is formed to extend vertically. At the side edge part of the container body 20 below the side sealed part 27, the front lower sheet tab 81 and the rear lower sheet tab 82 each of which is formed by the part of the sheet member (container body-forming sheet member 120) is disposed, the front-rear sealed part 83 given by mutual attachment of side edge parts of the front lower sheet tab 81 and the rear lower sheet tab 82 is formed, and, the skirt part 80 given by integration of the front lower sheet tab 81 and the rear lower sheet tab 82 via the front-rear sealed part 83 is formed.

The bottom face-forming sheet part 53 is formed with the non-attached part (annular non-attached part 63) where the film layers are left partially unattached to each other, and, when the filler is enclosed between the film layers in the non-attached part of the bottom face-forming sheet part 53, the container body 20 will be given a shape with the front face 21*a*, the rear face 21*b*, and the bottom face (bottom gusset 23), the bottom face will have formed therein an annular filled part (annular filled part 43) filled with the filler, the skirt part 80 will be disposed at the side end of the bottom of the container body 20, the side part of the annular filled part (annular filled part 43) will be the side bulging part 43*b* bulging toward the skirt part 80, the side bulging part 43*b* will press the pressed part 80*a* above the lower edge 80*b* of the skirt part 80 from the inside toward the sideward, the lower edge 80*b* of the skirt part 80 will be disposed inwardly from the pressed part 80*a*.

With such design, at least a part of the side sealed part 27 may be left fallen frontward or rearward.

In this embodiment, the front lower sheet tab 81 is a front lower laminated part where a part of the front face-forming sheet part 51 and a part of the bottom face-forming sheet part 53 (outer tab 81*a* and inner tab 81*b*) are overlapped with each other, meanwhile, the rear lower sheet tab 82 is a rear lower laminated part where a part of the rear face-forming sheet part 52 and a part of the bottom face-forming sheet part 53 (outer tab 82*a* and inner tab 82*b*) are overlapped with each other.

In more details, in the front lower laminated part in this embodiment, the part of the front face-forming sheet part 51 and the part of the bottom face-forming sheet part 53 (outer tab 81*a* and inner tab 81*b*) are mutually attached, meanwhile in the rear lower laminated part, the part of the rear face-forming sheet part 52 and the part of the bottom face-forming sheet part 53 (outer tab 82*a* and inner tab 82*b*) are mutually attached.

The sheet container 100 has the front non-attached part 65 in which the film layers are left partially unattached to each other in the front face-forming sheet part 51; the front filled part 45 formed by enclosing the filler between the film layers in the front non-attached part 65; the rear non-attached part 66 in which the film layers are left partially unattached to each other in the rear face-forming sheet part 52; and the rear filled part 46 formed by enclosing the filler between the film layers in the rear non-attached part 66, wherein, the front non-attached part 65 and the rear non-attached part 66 are communicate with the annular non-attached part (annular non-attached part 63) at their lower end, and, in the state that the sheet member (the container body-forming sheet member 120) is developed in a planar shape, each of the boundary part 151 between the front non-attached part 65 and the annular non-attached part, and the boundary part 152 between the rear non-attached part 66 and the annular non-attached part are constricted.

Here, "the container body-forming sheet member 120 of the sheet container 100 is developed in a planar shape" means that the filler is discharged from each of the filled parts of the sheet container 100 and the container body-forming sheet member 120 is spread flat.

The container-forming sheet 400 of this embodiment has the sheet member (container body-forming sheet member 120) that composes the container body 20, given by lamination of a plurality of film layers, the sheet member has the annular non-attached part (annular non-attached part 63) where the plurality of film layers are left partially unattached to each other, the sheet member has the front face-forming sheet part 51 that forms the front face 21*a* of the container body 20; the rear face-forming sheet part 52 that forms the rear face 21*b* of the container body 20; and the bottom face-forming sheet part 53 that forms the bottom face (bottom gusset 23) of the container body 20, and, when the container body 20 is formed by folding the sheet member, and by enclosing the filler between the plurality of film layers in the non-attached part to form the annular filled part (annular filled part 43), the container body 20 will be given a shape with the front face 21*a*, the rear face 21*b*, and the bottom face, at the side edge part of the container body 20, the side sealed part 27 given by mutual attachment of side edge parts of the front face-forming sheet part 51 and the rear face-forming sheet part 52, will be formed to extend vertically, at the side edge part of the container body 20 below the side sealed part 27, the front lower sheet tab 81 and the rear lower sheet tab 82 each of which is formed by the part of the sheet member will be disposed, the front-rear sealed part 83 given by mutual attachment of side edge parts of the front lower sheet tab 81 and the rear lower sheet tab 82 will be formed, and, the skirt part 80 given by integration of the front lower sheet tab 81 and the rear lower sheet tab 82 via the front-rear sealed part 83 will be formed, the skirt part 80 will be disposed at the side end of the bottom of the container body 20, the annular filled part will be disposed at the bottom, the side part of the annular filled part will be the side bulging part 43*b* bulging toward the skirt part 80, the side bulging part 43*b* will press the pressed part 80*a* above the lower edge 80*b* of the skirt part 80 from the inside toward the sideward, and the lower edge 80*b* of the skirt part 80 will be disposed inwardly from the pressed part 80*a*.

Here, each of the filled parts (first peripheral filled part 41, second peripheral filled part 42, annular filled part 43, lower transverse direction filled part 44, upper transverse direction filled part 47 and filled part 48) are preferably, but not limitatively, kept at a pressure higher than the atmospheric pressure, and for example at equal to or higher than 10 kPa and at equal to or lower than 500 kPa in terms of gauge pressure.

As a method of sealing the filled part, for example, there is a method that the non-attaching treatment is not performed at the part of the filled part 48 adjoining the non-attached part 69 so that the first film layer 121 and the second film layer 122 can be heat-sealed to each other; and heat-seal is not performed on that part in the process of manufacturing the container-forming sheet 400 and in the process of manufacturing the sheet for container 200; and heat-seal is performed on that part after the filler is enclosed.

After the sheet container 100 is manufactured, the article 96 is accommodated through the cylinder part 32 of the spout 30 into the accommodating area 20*a*, thereby the sheet container 100 filled with the article 96, that is, the packed article in sheet container 300, may be obtained.

There is no particular limitation on the temporal order between the timing of filling of the filler into each of the filled parts and the timing of accommodating of the article 96 into the accommodating area 20*a*. The article 96 may be accommodated in the accommodating area 20*a* after enclosing the filler into each of the filled parts; the filler may be enclosed in each of the filled parts after accommodating the article 96 into the accommodating area 20*a*; or, enclosure of the filler into each of the filled parts and accommodating of the article 96 into the accommodating area 20*a* may take place at the same time (in parallel).

According to the first embodiment described above, the side part of the annular filled part (annular filled part 43) formed in the bottom face (bottom gusset 23) of the sheet container 100 is the side bulging part 43*b* bulging toward the skirt part 80, the side bulging part 43*b* presses the pressed part 80*a* above the lower edge 80*b* of the skirt part 80 from the inside toward the sideward, and the lower edge 80*b* of the skirt part 80 being disposed inwardly from the pressed part 80*a*.

Therefore, at least a part of the side sealed part 27 may be left fallen frontward or rearward, making it possible to provide a soft touch on at least a part of the side sealed part 27.

Second Embodiment

Next, the sheet container 100 and the packed article in sheet container 300 of the second embodiment will be explained, referring to FIG. 18 to FIG. 24.

Figure 18:
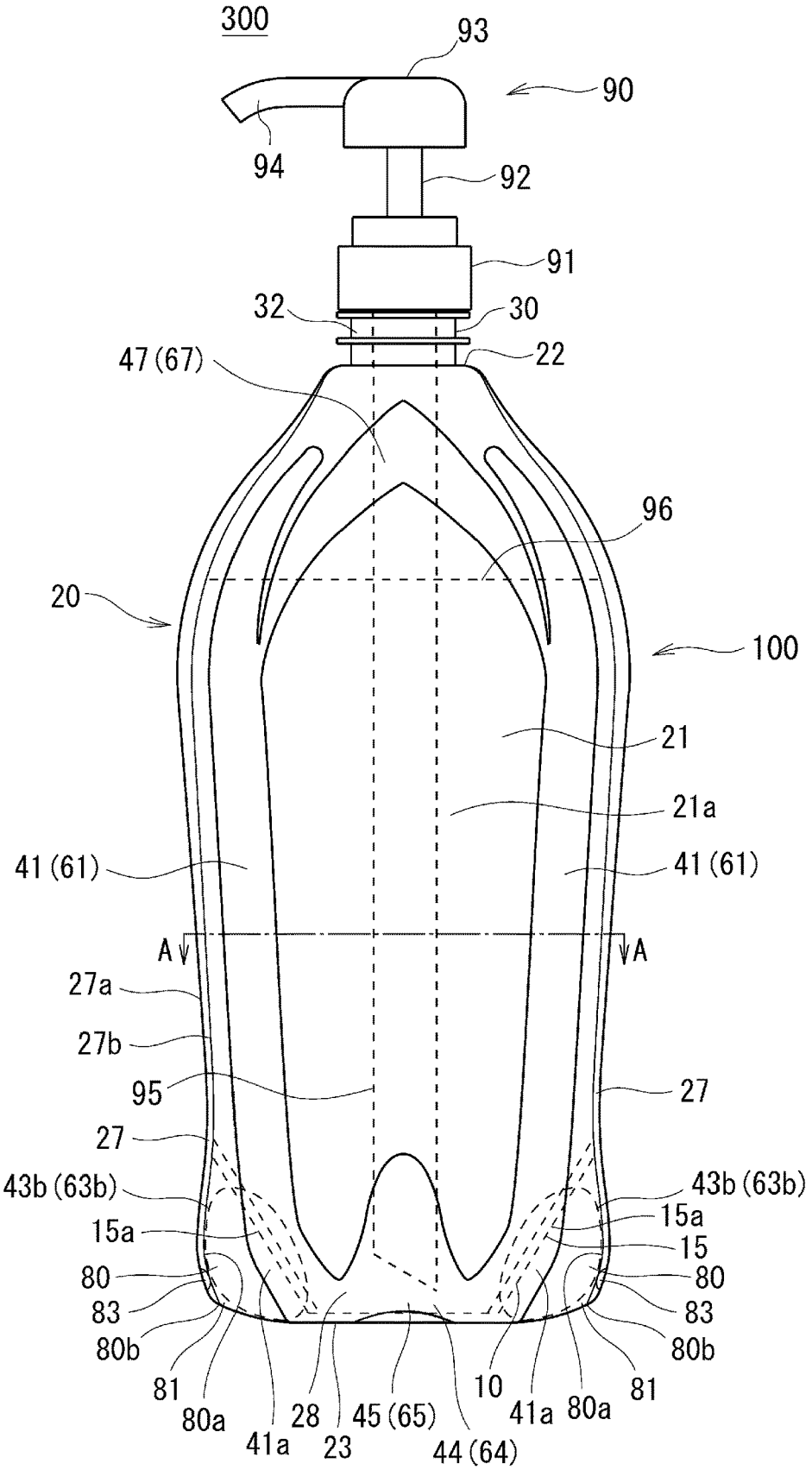
FIG. 18 is a front elevation illustrating a packed article in sheet container of a second embodiment.

As illustrated in FIG. 18, the sheet container 100 of this embodiment has the inner container 10 (FIG. 19) disposed inside the container body 20. That is, the container body 20 surrounds the inner container 10.

Figure 19:
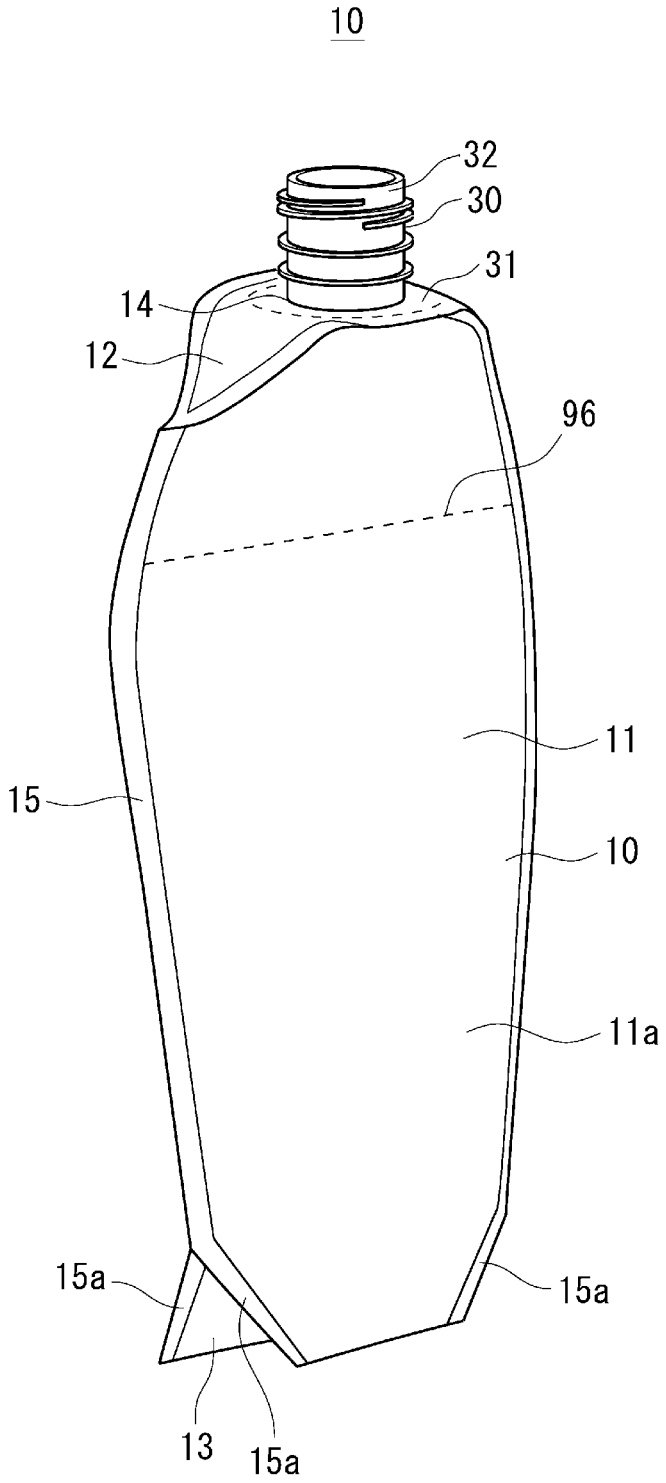
FIG. 19 is a perspective view illustrating the sheet container of the second embodiment.

FIG. 19 is a perspective view illustrating the inner container 10 of the sheet container 100 of the second embodiment. In other words, FIG. 19 is a perspective view illustrating the sheet container 100, leaving the container body 20 unillustrated.

As shown in FIG. 19, the inner container 10 has a top gusset 12 which is a gusset formed at the upper end part of the inner container 10, a bottom gusset 13 (FIG. 20) which is a gusset formed at the bottom of the inner container 10, and a trunk 11 which is a section of the inner container 10 located between the top gusset 12 and the bottom gusset 13.

The trunk 11 has a front face 11*a* and a rear face 11*b* (FIG. 24) which are opposed while placing the accommodating area 10*a* therebetween. In this embodiment, the container body 20 surrounds the accommodating area 10*a*.

The front face 11*a* and the bottom gusset 13 are mutually connected at the lower end part of the inner container 10. Similarly, the rear face 11*b* and the bottom gusset 13 are mutually connected at the lower end part of the inner container 10.

The front face 11*a* and the rear face 11*b* are mutually connected at the left and right side edge parts of the trunk 11.

The top gusset 12 has a central part where the level of height is relatively large in the lateral direction of the container body 10, and parts on both sides thereof which slope down towards the left and right ends of the inner container 10. Hence, the container body 10 has a shape of sloping shoulder.

The inner space of the inner container 10 is the accommodating area 10*a* (FIG. 24) for accommodating the article 96.

That is, in this embodiment, the accommodating area 10*a* for accommodating the article 96 is demarcated by the inner container 10. The article 96 accommodated in the accommodating area 10*a* is brought into direct contact with the inner surface of the inner container 10, but is not brought into direct contact with the inner surface of the container body 20.

The top gusset 12 has an opening 14 through which the article 96 in the accommodating area 10*a* may be discharged. As described later, in the top gusset 12, for example, there is provided the cylinder part 32 of the spout 30 so as to extend through the opening 14. Hence, in more details, the article 96 in the accommodating area 10*a* of the inner container 10 may be discharged through the spout 30 that extends through the opening 14.

Figure 21C:
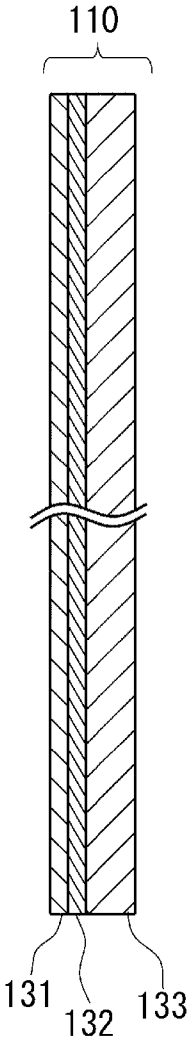
FIG. 21C is a cross-sectional view illustrating the inner container-forming sheet that composes the inner container of the sheet container of the second embodiment.
Figure 21B:
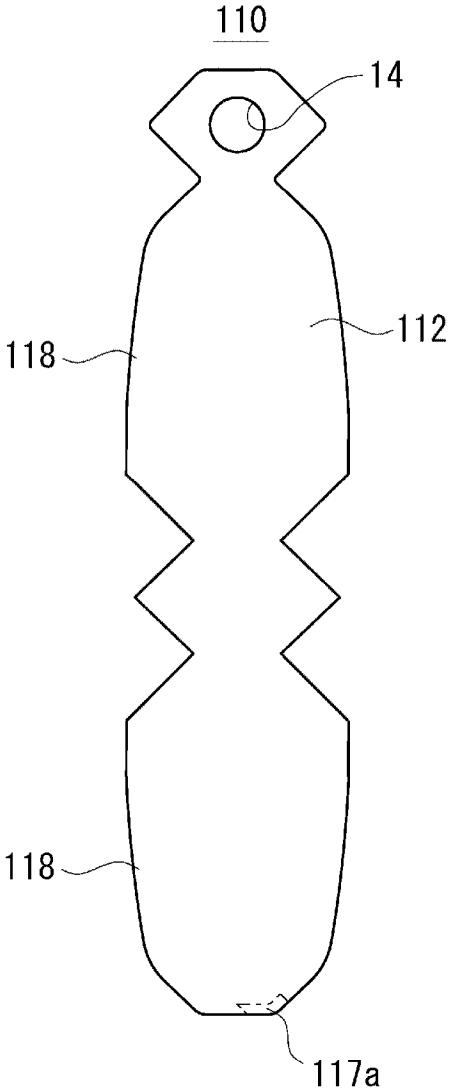
FIG. 21(*a*) is a plan view (inner surface side) illustrating an inner container-forming sheet that composes an inner container of the sheet container of the second embodiment, FIG. 21 (*b*) is a plan view (outer surface side) illustrating the inner container-forming sheet that composes the inner container of the sheet container of the second embodiment.
Figure 21A:
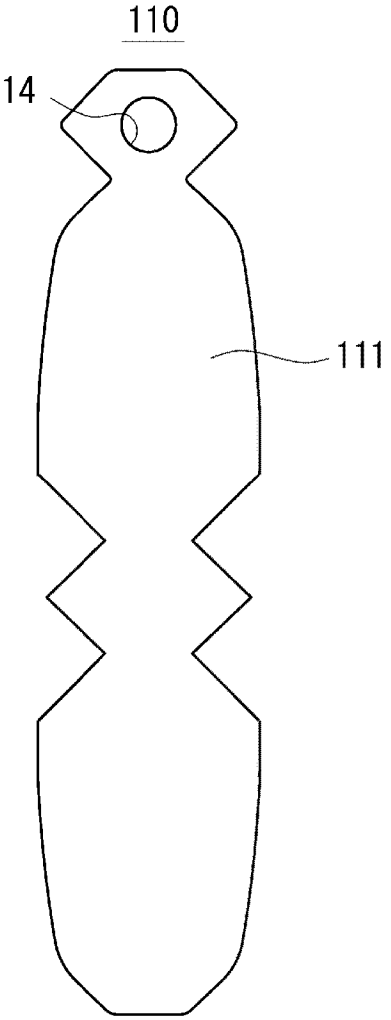

FIG. 21(*a*) and FIG. 21 (*b*) are plan views illustrating an inner container-forming sheet member 110 that composes the inner container 10, wherein FIG. 21(*a*) shows the surface of the inner container-forming sheet member 110 which serves as the inner surface (inner surface 111) of the inner container 10, meanwhile FIG. 21(*b*) shows the surface of the inner container-forming sheet member 110 which serves as the outer surface (outer surface 112) of the inner container 10. FIG. 21C is a cross-sectional view illustrating the inner container-forming sheet member 110.

In this embodiment, the inner container 10 is formed into a form illustrated in FIG. 19, by folding the inner container-forming sheet member 110 and by attaching the circumferential parts thereof to each other to form inner container sealed parts 15.

The parts of the inner container-forming sheet member 110 are attached to each other at the inner container sealed part 15 on the boundary part between the top gusset 12 and the trunk 11, at the inner container sealed part 15 on both lateral side edges of the trunk 11, and, at the inner container sealed part 15 on the boundary part between the trunk 11 and the bottom gusset 13. With such configuration, the inner container 10 has formed therein the accommodating area 10*a* which is an inner space of the inner container 10 tightly closed except for the opening 14. The parts of the inner container-forming sheet member 110 are mutually attached, for example, by heat sealing.

However, in the present invention, the inner container is not always necessarily composed of the sheet member, but may be formed by blow molding.

In this embodiment, the container body 20 and the inner container 10 are partially attached to each other (container body-forming sheet member 120 and the inner container-forming sheet member 110 are partially attached).

Since the inner container 10 is held by the container body 20, so that the inner container 10 may be prevented from creasing even if the inner container 10 (inner container-forming sheet member 110) is made thin, and the inner container 10 will more easily be collapsed or flattened. Hence, the article 96 will be prevented from remaining in the inner container 10.

The container body 20 and the inner container 10 are preferably attached at two or more places.

However, the present invention is not limited to the example above, wherein the container body 20 and the inner container 10 may be left unattached over the entire range (the container body 20 and the inner container 10 may be left unattached entirely). However, also in this case, the inner container 10 is preferably held by the container body 20 inside the container body 20.

Next, an exemplary layer structure of the inner container-forming sheet member 110 will be explained.

As illustrated in FIG. 21C, the inner container-forming sheet member 110 is, for example, composed of a first layer 131, a second layer 132, and a third layer 133 laminated in this order.

The first layer 131 is, for example, composed of linear low-density polyethylene.

The second layer 132 is, for example, a transparent evaporated oriented nylon layer that is composed of an oriented nylon film, and silica and alumina vapor-deposited on one surface thereof (the surface on the side of the first layer 131).

The third layer 133 is, for example, composed of linear low-density polyethylene.

Although the thickness of these layers is not specifically limited, the first layer 131 may be 25 μm thick, the second layer 132 may be 15 μm thick, and the third layer 133 may be 40 μm thick, for example.

An exemplary major function of the first layer 131 is to enhance heat sealability with the container body-forming sheet member 120.

An exemplary major function of the second layer 132 is to enhance gas barrier performance and pinhole resistance.

An exemplary major function of the third layer 133 is to enhance heat sealability between the parts of the inner container-forming sheet member 110.

The layer structure of the inner container-forming sheet member 110 is not limited to the one described above.

The first layer 131 is disposed on the outer surface side of the inner container 10 (that is, on the container body 20 side), meanwhile the third layer 133 is disposed on the inner surface side of the inner container 10 (that is, on the accommodating area 10*a* side).

The inner container 10 is formed by folding the inner container-forming sheet member 110 into the above-described shape with the trunk 11, the top gusset 12 and the bottom gusset 13, and then by attaching the circumferential parts of the third layer 133 of the inner container-forming sheet member 110 to each other.

As shown in FIG. 21(*a*) and FIG. 21(*b*), the inner container-forming sheet member 110 has the opening 14 which is formed in an area for composing the bottom gusset 13. The opening 14 is for example formed into the same size with the opening 24, and is disposed so as to overlap the opening 24. The opening 14 is slightly smaller than the opening 24*a*.

When the inner container-forming sheet member 110 and the container body-forming sheet member 120 are attached as explained below, the inner container-forming sheet member 110 and the container body-forming sheet member 120 are left partially unattached in the introducing part-forming part 117*a* illustrated in FIG. 21(*b*), allowing for introduction of the filler into the non-attached parts in the later process.

An area where the inner container-forming sheet member 110 and the container body-forming sheet member 120 are mutually attached is referred to as an interior/exterior sealed part 25.

Figure 22:
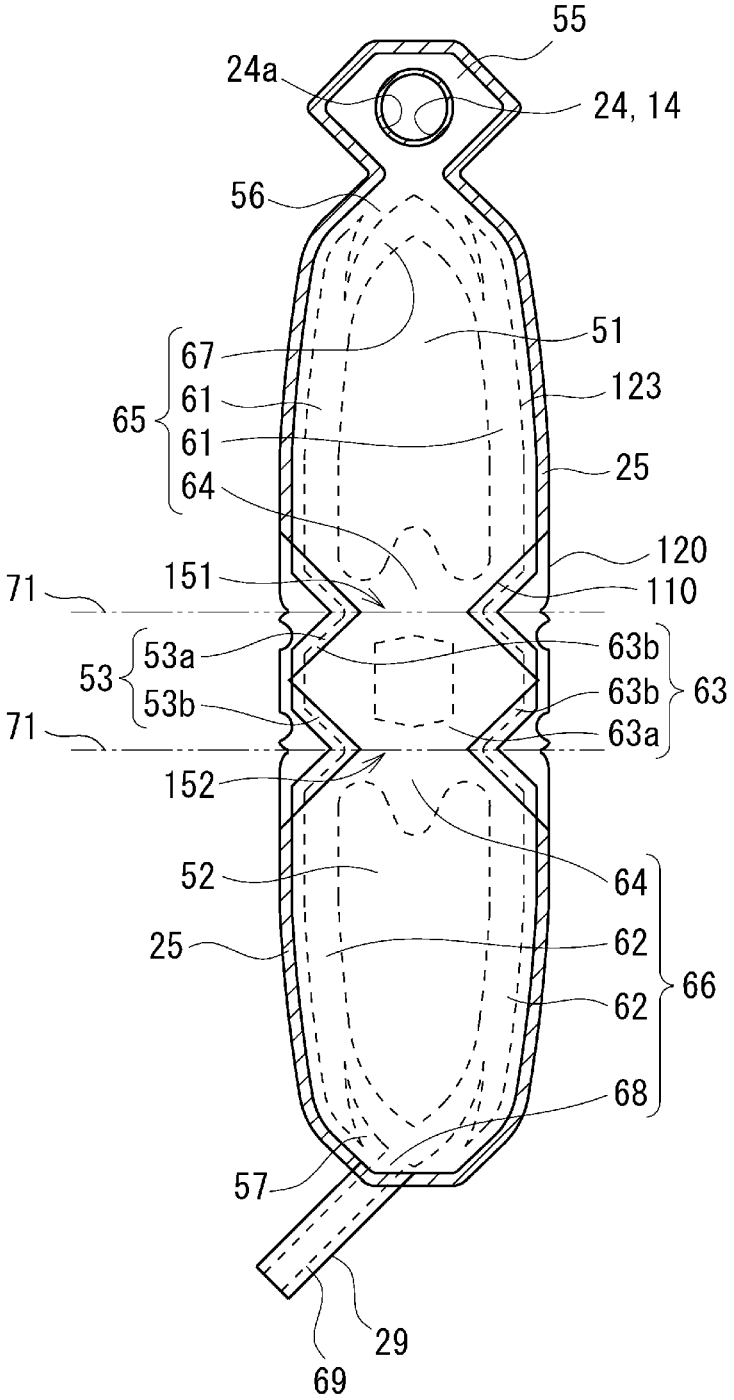
FIG. 22 is a plan view illustrating the container-forming sheet that composes the sheet container of the second embodiment, with a portion later formed into an accommodating area for accommodating an article directed to the top.

As illustrated in FIG. 22, the container body-forming sheet member 120 and the inner container-forming sheet member 110 are laminated, and partially attached to each other. That is, the circumferential part of the inner container-forming sheet member 110 is attached (for example by heat sealing) to apart of the first film layer 121 of the container body-forming sheet member 120, exposed around the periphery of the second film layer 122, and, a part of the inner container-forming sheet member 110 at around the opening 14 is attached (for example by heat sealing) to a part of the first film layer 121 located inside the opening 24*a*. In FIG. 22, an area where the container body-forming sheet member 120 and the inner container-forming sheet member 110 are mutually attached (interior/exterior sealed part 25) is hatched.

In this embodiment, a sheet member which is composed of the container body-forming sheet member 120 and the inner container-forming sheet member 110, and is equipped with the spout 30 (FIG. 23), will be referred to as the container-forming sheet 400.

In this embodiment, the base 31 of the spout 30 is fixed by adhesion to the inner container-forming sheet member 110 at around the circumference of the opening 14.

In more details, the base 31 of the spout 30 is fixed by adhesion to the inner container-forming sheet member 110 on the surface thereof which composes the inner surface of the inner container 10. However, the present invention is not limited to this example, wherein the base 31 may be disposed between the first film layer 121 and the second film layer 122 that compose the container body 20, and may be fixed by adhesion to at least one of the first film layer 121 and the second film layer 122. Alternatively, the base 31 may be disposed between the outer surface of the inner container 10 and the inner surface of the container body 20, and may be fixed by adhesion to at least one of the outer surface of the inner container 10 and the inner surface of the container body 20.

In this embodiment, the front face-forming sheet part 51 composes the front face 11*a* of the inner container 10, and the front face 21*a* of the container body 20.

The rear face-forming sheet part 52 composes the rear face 11*b* of the inner container 10, and the rear face 21*b* of the container body 20.

The bottom face-forming sheet part 53 (front part 53*a* and rear part 53*b*) composes the bottom gusset 13 of the inner container 10, and the bottom gusset 23 of the container body 20.

The top gusset sheet part 55 composes the top gusset 22 of the inner container 10, and the bottom gusset 23 of the container body 20.

In this embodiment, the sheet for container is formed by folding the container-forming sheet 400, and by attaching the circumferential parts of the inner container-forming sheet member 110 (for example by heat sealing).

That is, by heat sealing the container-forming sheet 400, the sealed part 15 as well as the inner container 10 are formed, and, the sealed part 27 as well as the container body 20 that covers the inner container 10 are formed.

In addition, the parts corresponding to the notched part 58 are locally heat-sealed, whereby the front-rear sealed part 83 is formed.

The circumferential part of the top gusset 22 is attached to a part of the inner container 10 at around the top gusset 12; the boundary of the top gusset 22 in the front face 21*a* is attached to the boundary of the top gusset 12 in the front face 11*a*; the boundary of the top gusset 22 in the rear face 21*b* is attached to the boundary of the top gusset 12 in the rear face 11*b*; each of the left and right side edge parts (except for the lower end part) of the front face 21*a* is attached to each of the left and right side edge parts of the front face 11*a*; each of the left and right side edge parts of the rear face 21*b* (except for the lower end part) is attached to each of the left and right side edge parts of the rear face 11*b*; and at each of the left and right side edge parts of the lower end part of the trunk 21, the parts of the container body-forming sheet member 120 that compose the container body 20 are attached to each other (that is, the outer tab 81*a* and the inner tab 81*b* are attached, the outer tab 82*a* and the inner tab 82*b* are attached, and, the outer tab 81*a* and the outer tab 82*a* are attached in the front-rear sealed part 83).

In this embodiment, the top gusset 22 covers the top face side of the top gusset 12.

The trunk 21 covers the periphery of the trunk 11. That is, the front face 21*a* covers the front face side of the front face 11*a*, and the rear face 21*b* covers the rear face side of the rear face 11*b*.

The bottom gusset 23 covers the bottom face side of the bottom gusset 13.

Figure 20:
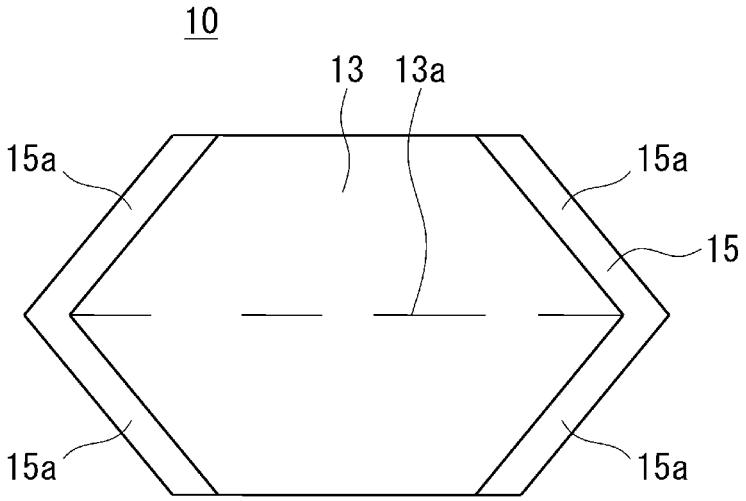
FIG. 20 is a bottom view illustrating an inner container of the sheet container of the second embodiment.

As illustrated in FIG. 20, the inner container sealed part 15 is formed in the circumferential part of the bottom gusset 13. The inner container sealed part 15 in the circumferential part of the bottom gusset 13 includes four bottom gusset peripheral sealed parts 15*a* that are individually laid straight.

The bottom gusset peripheral sealed parts 15*a* are individually interposed between the lower part 41*a* of the left first peripheral filled part 41 and the left side bulging part 43*b*, between the lower part 41*a* of the right first peripheral filled part 41 and the right side bulging part 43*b*, between the lower part 42*a* of the left second peripheral filled part 42 and the left side bulging part 43*b*, and, between the lower part 42*a* of the right second peripheral filled part 42 and the side bulging part 43*b*.

With such design, it is possible to suppress the lower part of the inner container 10 from being lifted up, so that it is possible to sufficiently discharge the article 96 in the inner container 10 from the sheet container 100.

As described above, the sheet container 100 of this embodiment has the inner container 10 composed of the inner container-forming sheet member 110 with the circumferential parts thereof attached to each other, having the accommodating area 10*a*, and being covered with the container body 20, wherein portions (each of the bottom gusset peripheral sealed parts 15*a*) of the inner container sealed parts 15 where the circumferential parts of the inner container-forming sheet member 110 are mutually attached, are interposed individually between the side bulging part 43*b* and the first peripheral filled part 41, and between the side bulging part 43*b* and the second peripheral filled part 42.

In other words, the sheet container 100 of this embodiment has inner container 20 composed of the inner container-forming sheet member 110 with the circumferential parts thereof attached to each other, having the accommodating area 10*a*, and being covered with the container body 20, wherein portions (the individual bottom gusset peripheral sealed parts 15*a*) of the inner container sealed part 15, where the circumferential parts of the inner container-forming sheet member 110 are mutually attached, are interposed individually between the side bulging part 43*b* and the front filled part 45, and between the side bulging part 43*b* and the rear filled part 46.

Modified Example 1 of Second Embodiment

Figure 31:
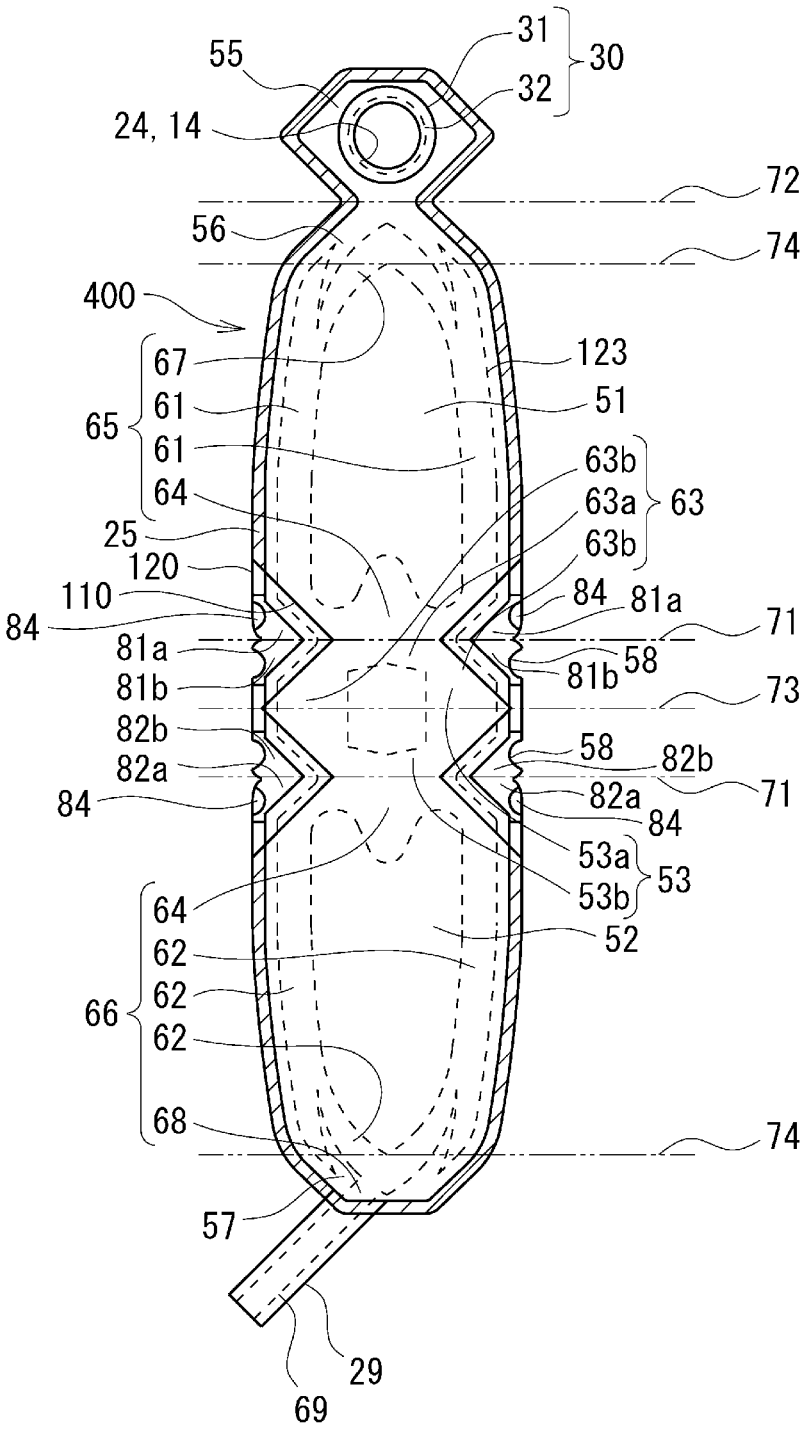
FIG. 31 is a plan view illustrating the container-forming sheet that composes the sheet container according to Modified Example 1 of the second embodiment, with a portion later formed into an accommodating area for accommodating an article directed to the top.

Next, Modified Example 1 of the second embodiment will be explained, referring to FIG. 31.

In the above described second embodiment, in the same way as in the first embodiment, the outer tab 81*a* and the inner tab 81*b* are mutually attached to form the front lower sheet tab 81; the outer tab 82*a* and the inner tab 82*b* are mutually attached to form the rear lower sheet tab 82, and, the front lower sheet tab 81 and the rear lower sheet tab 82 are attached at the front-rear sealed part 83.

In contrast in this Modified Example, the inner tab 81*b* is subjected to non-attaching treatment, and the outer tab 81*a* is subjected to non-attaching treatment in the area thereof excluding the attaching part 84 that corresponds to the notched part 58. Hence, the front lower sheet tab 81 (FIG. 2, FIG. 4, FIG. 5(*b*)) is a front lower laminated part where the outer tab 81*a* and the inner tab 81*b* are merely laminated (the outer tab 81*a* and the inner tab 81*b* are not attached).

Similarly, the inner tab 82*b* is subjected to non-attaching treatment, and the outer tab 82*a* is subjected to non-attaching treatment in the area thereof excluding the attaching part 84 that corresponds to the notched part 58. Hence, the rear lower sheet tab 82 (FIG. 3, FIG. 4, FIG. 5(*b*)) is a rear lower laminated part where the outer tab 82*a* and the inner tab 82*b* are merely laminated (the outer tab 82*a* and the inner tab 82*b* are not attached).

In this Modified Example, an attaching part 84 of the front lower sheet tab 81 and an attaching part 84 of the rear lower sheet tab 82 are mutually attached to form the front-rear sealed part 83, and the skirt part 80 is formed by the front lower sheet tab 81 and the rear lower sheet tab 82.

Modified Example 2 of Second Embodiment

Figure 32:
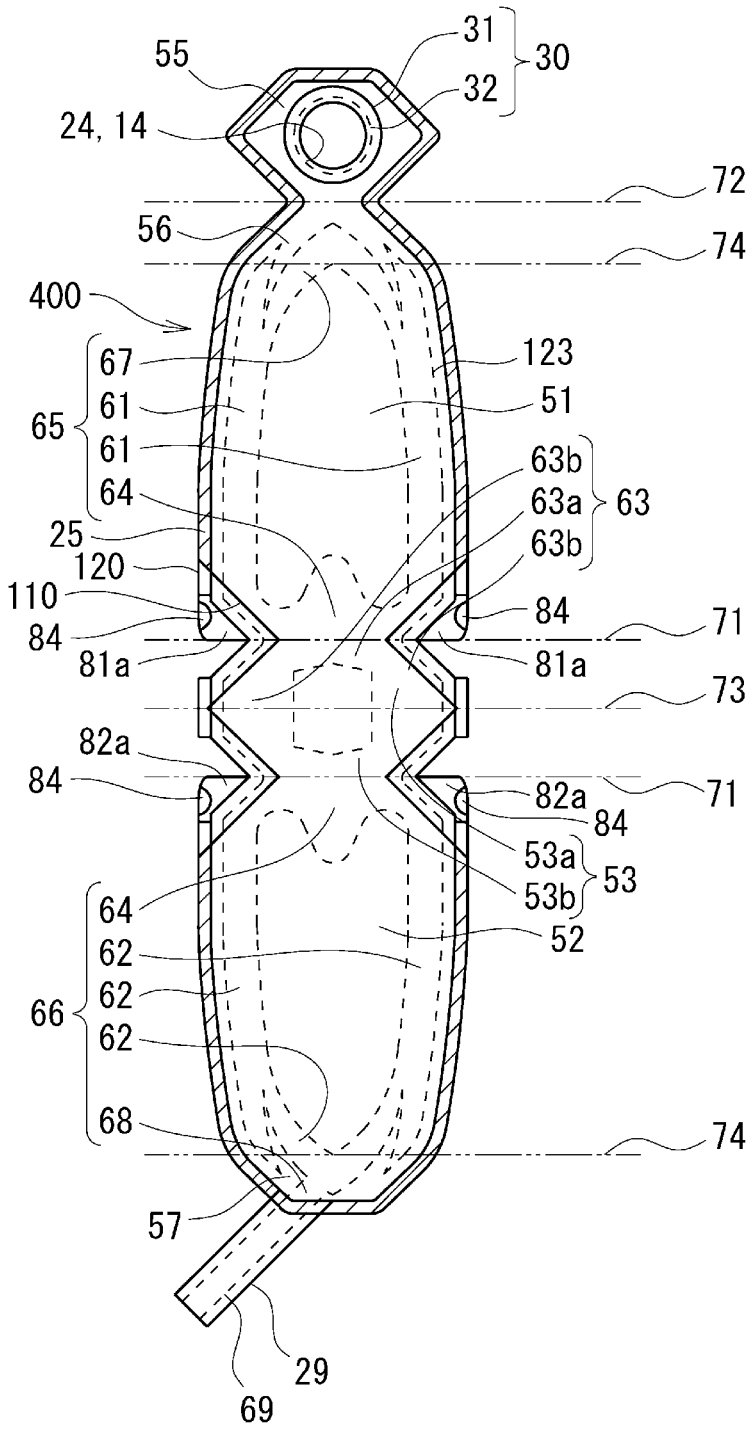
FIG. 32 is a plan view illustrating the container-forming sheet that composes the sheet container according to Modified Example 2 of the second embodiment, with a portion later formed into an accommodating area for accommodating an article directed to the top.

Next, Modified Example 2 of the second embodiment will be explained referring to FIG. 32.

In Modified Example 1 described above (FIG. 31), the front lower sheet tab 81 is a laminate (front lower laminated part) of the outer tab 81*a* and the inner tab 81*b*, and the rear lower sheet tab 82 is a laminate (rear lower laminated part) of the outer tab 82*a* and the inner tab 82*b*.

In contrast, the container-forming sheet 400 of this Modified Example has neither the inner tab 81*b* nor the inner tab 82*b*. The container-forming sheet 400 of this Modified Example is same as the container-forming sheet 400 of Modified Example 1 in other aspects.

Hence, the front lower sheet tab 81 is composed of the outer tab 81*a*, without containing the inner tab 81*b*. Similarly, the rear lower sheet tab 82 is composed of the outer tab 82*a*, without containing the inner tab 82*b*.

In this Modified Example, the attaching part 84 of the front lower sheet tab 81 and the attaching part 84 of the rear lower sheet tab 82 are mutually attached to form the front-rear sealed part 83, and, so that the skirt part 80 is composed of the front lower sheet tab 81 and the rear lower sheet tab 82.

Third Embodiment

Next, a third embodiment will be explained referring to FIG. 25 to FIG. 30.

Figure 25:
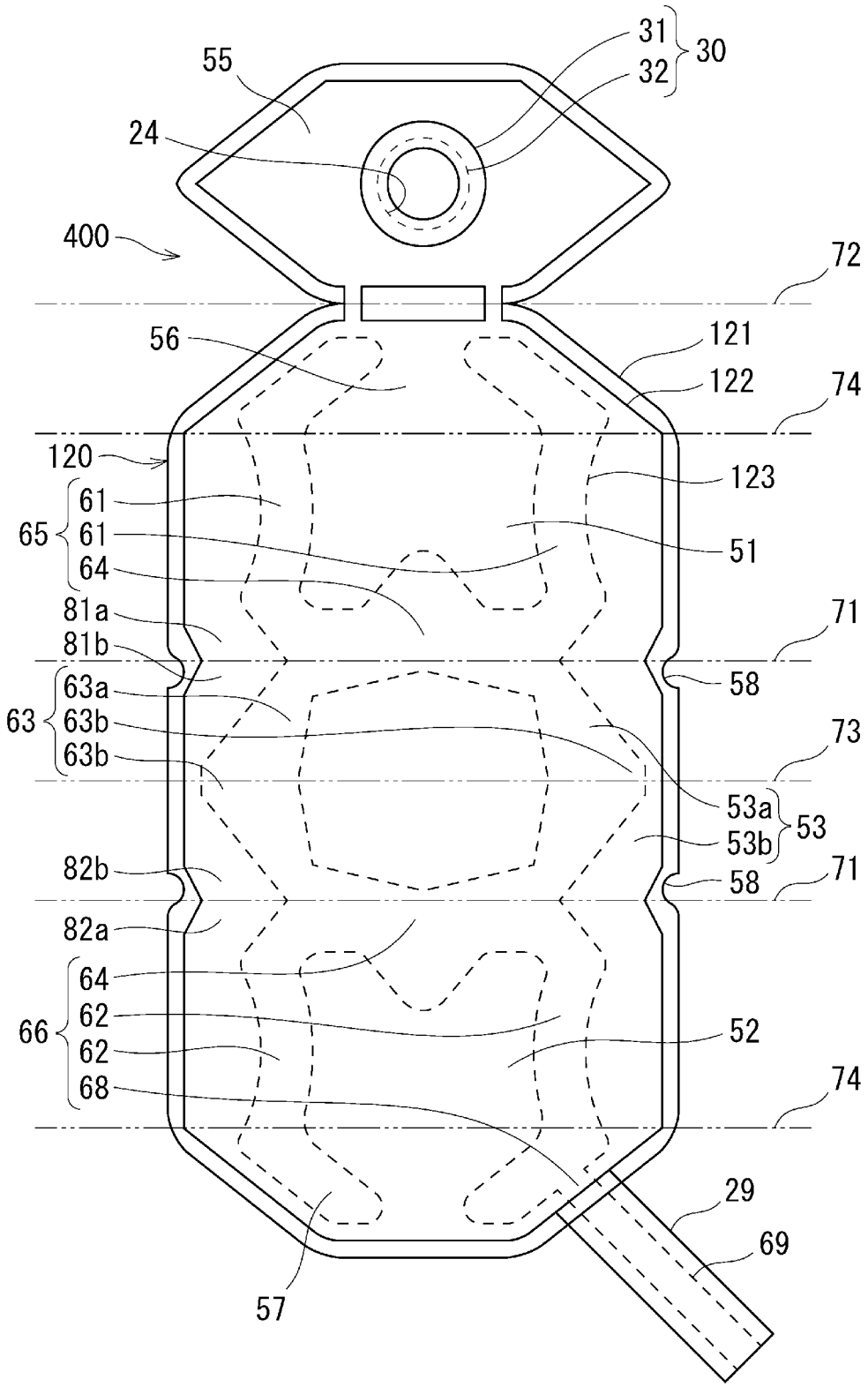
FIG. 25 is a plan view illustrating the sheet member (container body-forming sheet member) that composes a container body of a sheet container of a third embodiment, with a portion later formed into an accommodating area for accommodating an article directed to the top.

In this embodiment, the sheet container 100 illustrated in FIG. 26 to FIG. 30 is formed, by folding and heat-sealing the container-forming sheet 400 illustrated in FIG. 25 in the same way as in the first embodiment.

In this embodiment, the sheet container 100 has no inner container 10, similarly to that in the first embodiment.

In this embodiment, each of the first peripheral non-attached parts 61 and each of the second peripheral filled parts 42 are curved as illustrated in FIG. 25, and each of the first peripheral filled parts 41 and each of the second peripheral filled parts 42 are curved as illustrated in any one of FIG. 26 to FIG. 30, and the sheet container 100 have a structure detailed below.

Figure 28:
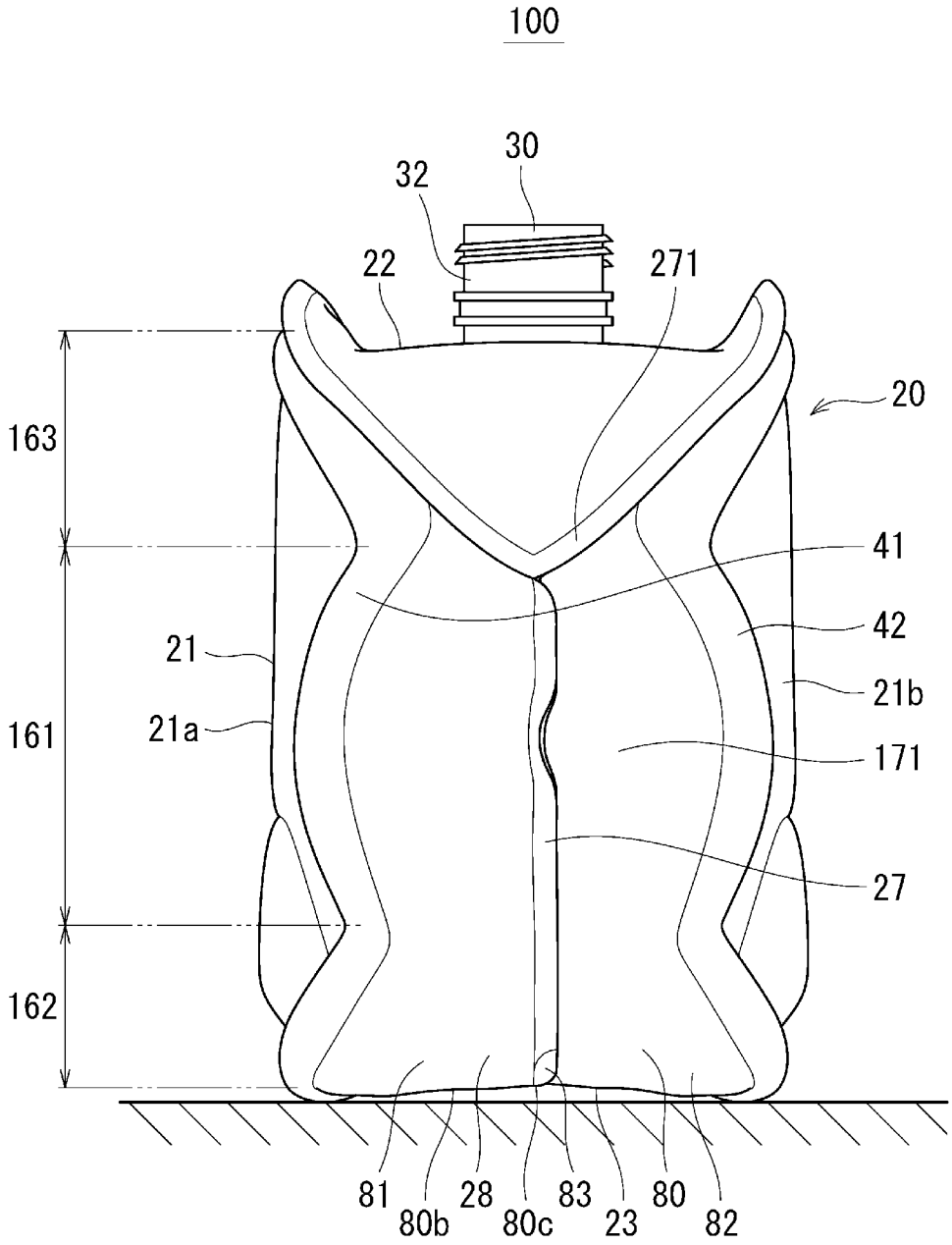
FIG. 28 is a right side elevation illustrating the sheet container of the third embodiment.

As illustrated in FIG. 28, the distance between the first peripheral filled part 41 and the second peripheral filled part 42 in the front-rear direction of the container body 20 differs depending on the level of height in the vertical direction.

This makes it possible to bend the container body 20 between the first peripheral filled part 41 and the second peripheral filled part 42, and thereby the side sealed part 27 may be left fallen frontward or rearward, according to the same mechanism described in the first embodiment referring to FIG. 17.

Hence, it now becomes possible to lay down the side sealed part 27 frontward or rearward, within such a wide area in which the fall of the side sealed part 27 as a result of pressing the skirt part 80 by the side bulging part 43*b* does not take effect.

The side sealed part 27 can therefore provide a soft touch over a wider range thereof.

As described above, in the sheet container 100 of this embodiment, the first peripheral non-attached part 61, where the film layers are left partially unattached to each other, is disposed so as to extend vertically along at least one of both side edges of the front face 21*a*; the second peripheral non-attached part 62, where the film layers are left partially unattached to each other, is disposed so as to extend vertically on the rear face 21*b* at a place behind the first peripheral non-attached part; and the first peripheral filled part 41 and the second peripheral filled part 42 are formed by enclosing the filler between the film layers in each of the first peripheral non-attached part 61 and the second peripheral non-attached part 62, disposed so as to extend vertically, wherein, the front non-attached part 65 includes the first peripheral non-attached part 61, the rear non-attached part 66 includes the second peripheral non-attached part 62, the front filled part 45 includes the first peripheral filled part 41, the rear filled part 46 includes the second peripheral filled part 42, and the distance between the first peripheral filled part 41 and the second peripheral filled part 42 in the front-rear direction of the container body 20 differs depending on the level of height in the vertical direction.

In other words, in the sheet container 100 of this embodiment, the first peripheral non-attached part 61, where the film layers are left partially unattached to each other, is disposed so as to extend vertically along at least one of both side edges of the front face 21*a*; the second peripheral non-attached part 62, where the film layers are left partially unattached to each other, is disposed so as to extend vertically on the rear face 21*b* at a place behind the first peripheral non-attached part; and the first peripheral filled part 41 and the second peripheral filled part 42 are formed by enclosing the filler between the film layers in each of the first peripheral non-attached part 61 and the second peripheral non-attached part 62, disposed so as to extend vertically, and the distance between the first peripheral filled part 41 and the second peripheral filled part 42 in the front-rear direction of the container body 20 differs depending on the level of height in the vertical direction.

In more details, for example as illustrated in FIG. 28, in a partial area 161 in the vertical direction of the container body 20, toward the upper side, the distance between the first peripheral filled part 41 and the second peripheral filled part 42 is, gradually widened and then gradually narrowed, and in the partial area 161, a portion between the first peripheral filled part 41 and the second peripheral filled part 42 is recessed inwardly.

Figure 26:
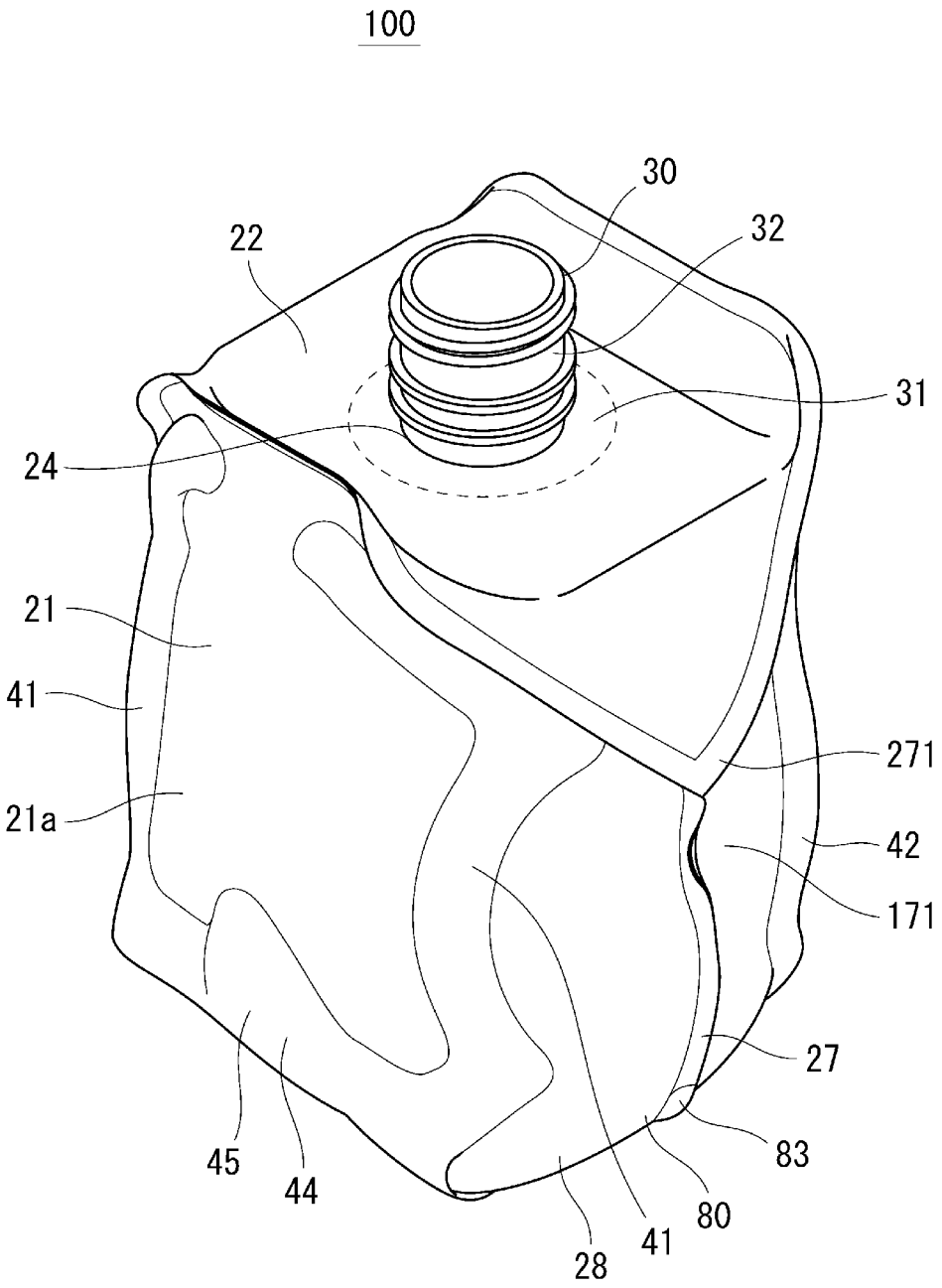
FIG. 26 is a perspective view illustrating the sheet container of the third embodiment.
Figure 27:
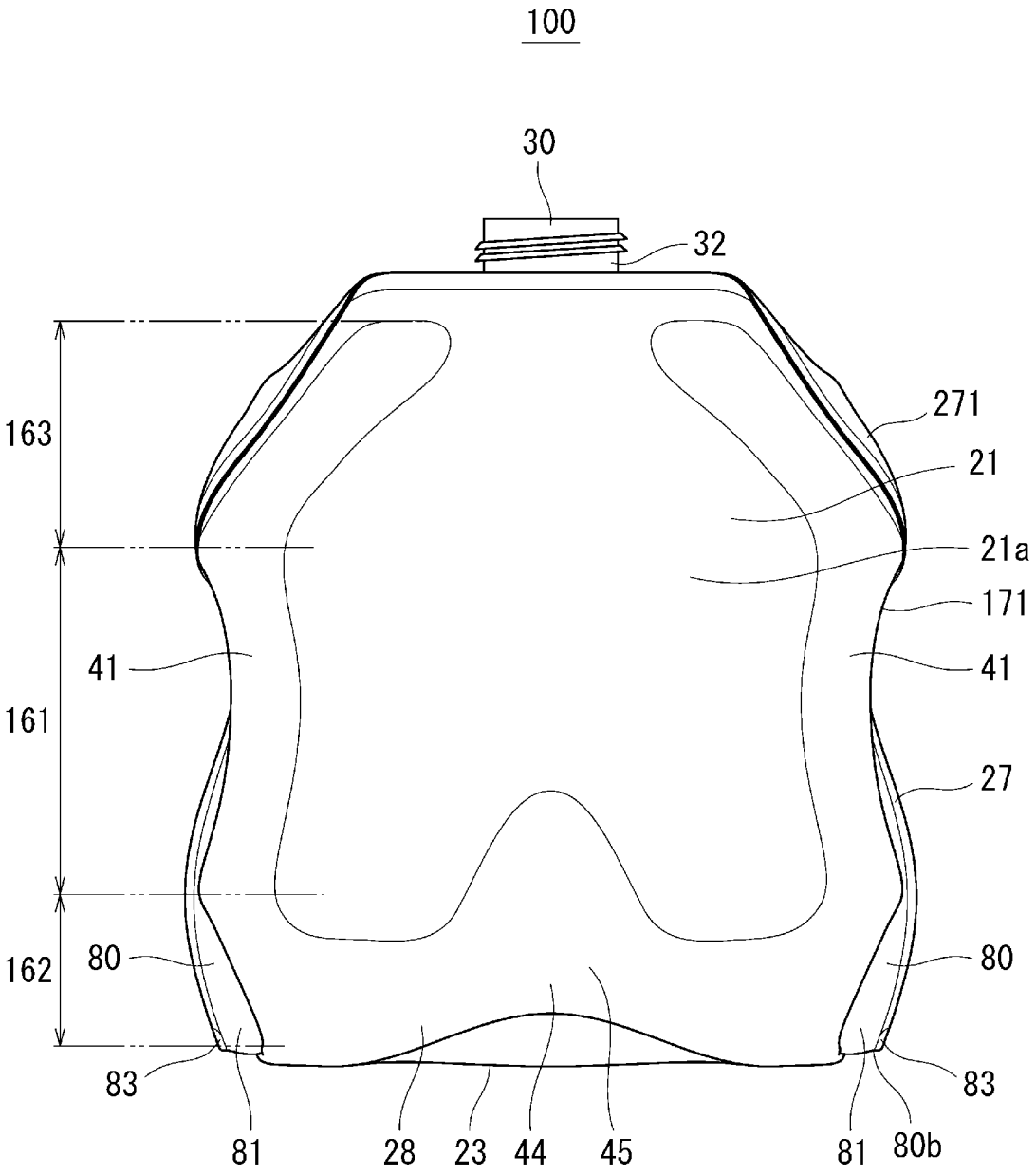
FIG. 27 is a front elevation illustrating the sheet container of the third embodiment.

That is, in the partial area 161, a portion between the first peripheral filled part 41 and the second peripheral filled part 42 is given as a recess 171 (see also FIG. 26 and FIG. 27).

As a result of provision of the recess 171 on the side of the container body 20, the side sealed part 27 may now be left fallen frontward or rearward, mainly in the partial area 161.

That is, according to the same mechanism described in the first embodiment referring to FIG. 17, the force which acts to equalize the length of the side 27*a* and the side 27*b* will be exerted on the side sealed part 27, and this can make the side sealed part 27 fall frontward or rearward.

In more details, for example, as illustrated in FIG. 27, the first peripheral filled part 41 is disposed along each of both side edges of the front face 21*a*, and in a front elevation, toward the upper side, the distance between the first peripheral filled parts 41 in the partial area 161 is gradually narrowed and then gradually widened.

With such design, the recess 171 will have a more sufficiently recessed form, and this makes the side sealed part 27 fall frontward or rearward in a more reliable manner.

Also in this embodiment, the first peripheral filled part 41 and the second peripheral filled part 42 are formed symmetrically in the front-rear direction. Hence, although not illustrated, the second peripheral filled part 42 is disposed along each of both side edges of the rear face 21*b*, and in a rear view, toward the upper side, the distance between the second peripheral filled parts 42 in the partial area 161 is gradually narrowed and then gradually widened.

With such design, the recess 171 will have a more sufficiently recessed form, and this makes the side sealed part 27 fall frontward or rearward in a more reliable manner.

In more details, in a lower area 162 adjoining below the partial area 161 of the container body 20, toward the lower side, the distance between the first peripheral filled part 41 and the second peripheral filled part 42 is gradually widened.

With such design, the side face of the container body 20 will be convex outwards (towards the side) on the boundary part between the partial area 161 and the lower area 162.

Hence, the force which acts to equalize the length of the side 27*a* and the side 27*b*, mainly on the boundary part between the partial area 161 and the lower area 162, will be exerted on the side sealed part 27, and this can make the side sealed part 27 fall frontward or rearward.

In more details, for example as illustrated in FIG. 27, the first peripheral filled part 41 is disposed along each of both side edges of the front face 21*a*, and in a front elevation, toward the lower side, the distance between the first peripheral filled parts 41 in the lower area 162 is gradually narrowed.

With such design, the side face of the container body 20 will be convex outwards (towards the side) more sufficiently, on the boundary part between the partial area 161 and the lower area 162.

Although not illustrated, the second peripheral filled part 42 is disposed along each of both side edges of the rear face 21*b*, and in a rear view, toward the upper side, the distance between the second peripheral filled parts 42 in the lower area 162 is gradually narrowed.

With such design, the side face of the container body 20 will be convex outwards (towards the side) more sufficiently, on the boundary part between the partial area 161 and the lower area 162.

In more details, for example as illustrated in FIG. 28, in an upper area 163 adjoining above the partial area 161 of the container body 20, toward the upper side, the distance between the first peripheral filled part 41 and the second peripheral filled part 42 is gradually widened.

With such design, the side face of the container body 20 will be convex outwards (towards the side), on the boundary part between the partial area 161 and the upper area 163.

Hence, mainly on the boundary part between the partial area 161 and the upper area 163, the side sealed part 27 may be made to fall frontward or rearward.

The sealed part 271 illustrated in FIG. 26 is an aggregate of the sealed part between the front face-forming sheet part 51 and the top gusset sheet part 55, and the sealed part between the rear face-forming sheet part 52 and the top gusset sheet part 55.

As described here, since the side face of the container body 20 is convex outwards on the boundary part between the partial area 161 and the upper area 163, so that also the sealed part 271 may be laid down frontward or rearward, making it possible to provide a soft touch of the sealed part 271.

Figure 29:
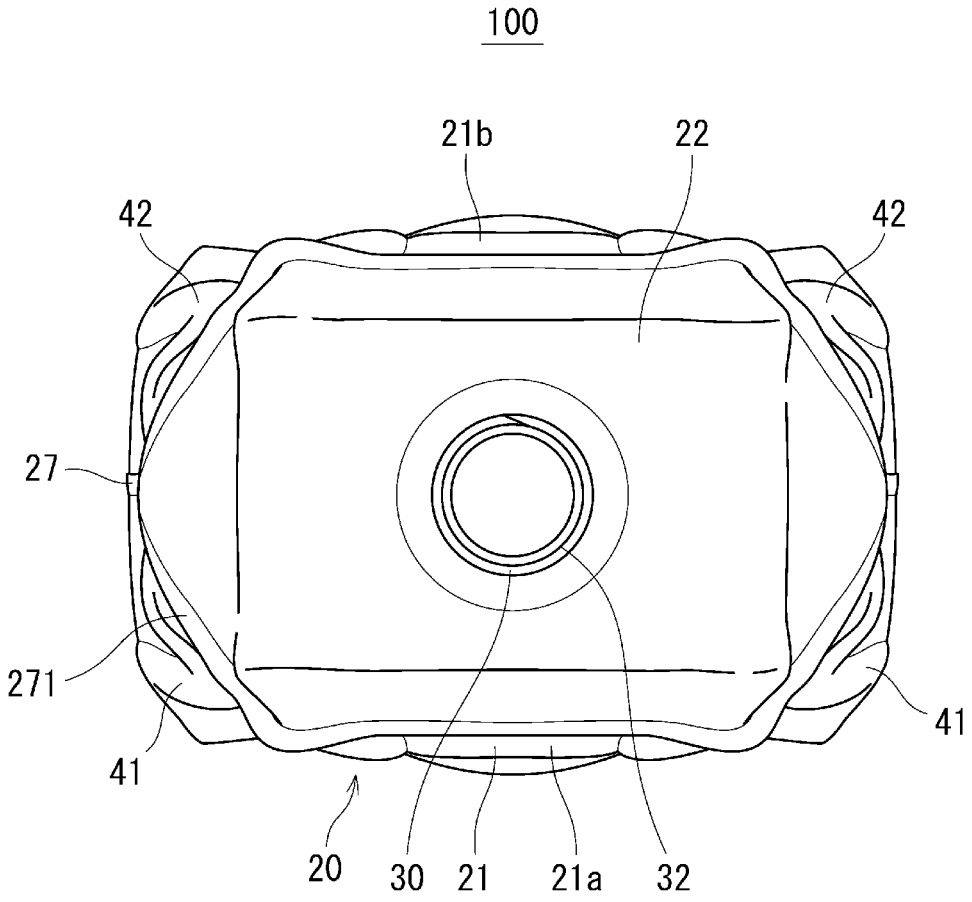
FIG. 29 is a plan view illustrating the sheet container of the third embodiment.

In one example, as illustrated in FIG. 29, it becomes now possible to lay down a portion of the sealed part 271 located in the front part of the top gusset 22 frontward, and to lay down a portion of the sealed part 271 located in the rear part of the top gusset 22 rearward.

In more details, for example, as illustrated in FIG. 27, the first peripheral filled part 41 is disposed along each of both side edges of the front face 21*a*, and in a front elevation, toward the upper side, the distance between the first peripheral filled parts 41 in the upper area 164 is gradually narrowed.

With such design, the side face of the container body 20 will be convex outwards (towards the side) more sufficiently, on the boundary part between the partial area 161 and the upper area 163.

Although not illustrated, the second peripheral filled part 42 is disposed along each of both side edges of the rear face 21*b*, and in a rear view, toward the upper side, the distance between the second peripheral filled parts 42 in the upper area 163 is gradually narrowed.

With such design, the side face of the container body 20 will be convex outwards (towards the side) more sufficiently, on the boundary part between the partial area 161 and the upper area 163.

Figure 30:
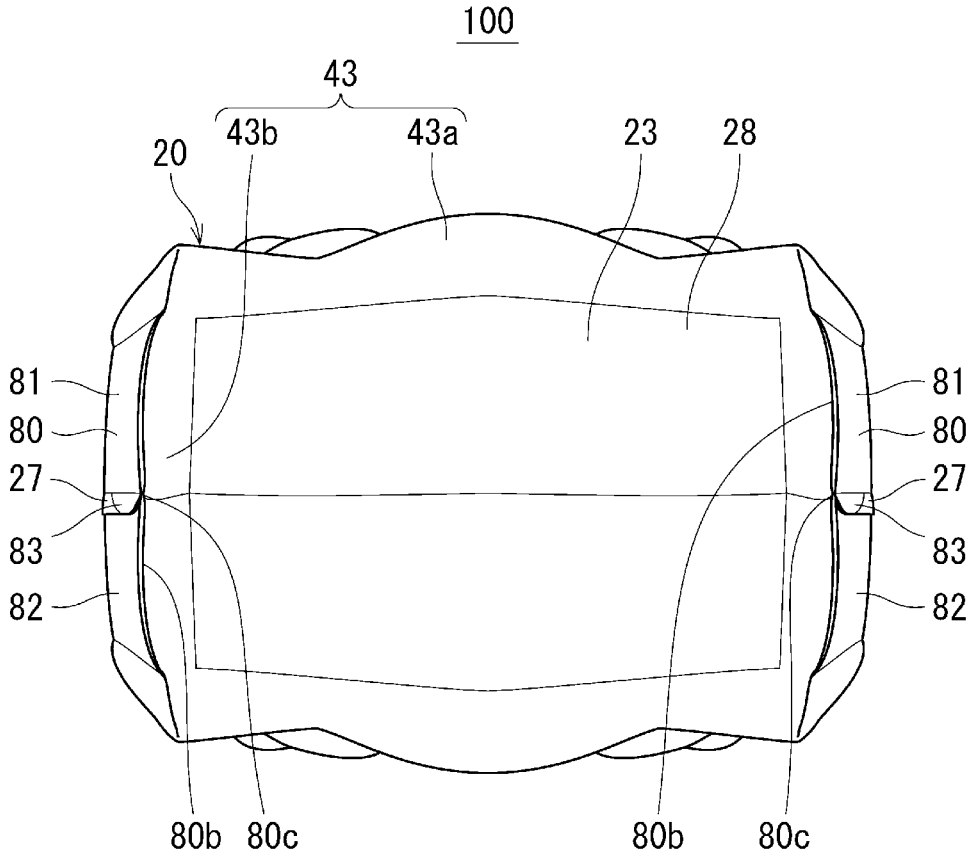
FIG. 30 is a bottom view illustrating the sheet container of the third embodiment.

As illustrated in FIG. 27, FIG. 28 and FIG. 30, in this embodiment, in the front-rear sealed part 83, the lower end part of the front lower sheet tab 81 and the lower end part of the rear lower sheet tab 82 are locally attached.

With such design, it now becomes possible to provide a structure in which the strength of the skirt part 80 may sufficiently be enhanced, and the front lower sheet tab 81 and the rear lower sheet tab 82 are suppressed from separating in the front-rear sealed part 83.

In this embodiment, the container-forming sheet 400 does not have the upper transverse direction non-attached part 67 (see FIG. 8), for example. Hence the front filled part 45 and the rear filled part do not have the upper transverse direction filled part 47 (see FIG. 1, etc.).

The sheet container 100 of this embodiment may alternatively be specified as below.

That is, the sheet container 100 of this embodiment includes a container body 20 that surrounds the accommodating area 20*a* for accommodating the article 96, the container body 20 is composed of the sheet member (the container body-forming sheet member 120) given by lamination of the plurality of film layers (for example, two film layers including the first film layer 121 and the second film layer 122), and includes the front face 21*a*, the rear face 21*b*, and the bottom face (bottom gusset 23), the sheet member includes the front face-forming sheet part 51 that forms the front face 21*a*; the rear face-forming sheet 52 part that forms the rear face 21*b*; and the bottom face-forming sheet part 53 that forms the bottom face, the first peripheral non-attached part 61, where the film layers are left partially unattached to each other, is disposed so as to extend vertically along at least one of both side edges of the front face 21*a*; the second peripheral non-attached part 62, where the film layers are left partially unattached to each other, is disposed so as to extend vertically on the rear face 21*b* at a place behind the first peripheral non-attached part 61; the first peripheral filled part 41 and the second peripheral filled part 42 formed by enclosing the filler between the film layers in each of the first peripheral non-attached part 61 and the second peripheral non-attached part 62, are disposed so as to extend vertically; and the distance between the first peripheral filled part 41 and the second peripheral filled part 42 in the front-rear direction of the container body 20 differs depending on the level of height in the vertical direction.

The present invention is not limited to the embodiments and the individual Modified Examples described above, instead including various alterations and modifications so long as the purpose of the present invention is attainable.

For example, the sheet container 100 explained in the embodiments above as having the front filled part 45 and the rear filled part 46, may lack either one of the front filled part 45 and the rear filled part 46, or may lack both of them. Hence the sheet container 100 may lack either one of the front non-attached part 65 and the rear non-attached part 66, or may lack both of them.

When the sheet container 100 has the front filled part 45, the front filled part 45 may lack at least any one of the left first peripheral filled part 41, the right first peripheral filled part 41, the lower transverse direction filled part 44, and the upper transverse direction filled part 47. Similarly, when the sheet container 100 has the rear filled part 46, the rear filled part 46 may lack at least any one of the left second peripheral filled part 42, the right second peripheral filled part 42, the lower transverse direction filled part 44, and the upper transverse direction filled part 47.

In the second embodiment described above, the front face 21*a* and the rear face 21*b* may be left unattached to each other in at least one side edge part of the trunk 21, so as to leave an opening in this side edge part.

The above description dealt with the case where the bottom gusset peripheral sealed part 15*a* at the bottom of the inner container 10 is interposed between the filled parts at the bottom of the container body 20. In addition to such design, the inner container sealed part 15 of the bottom gusset 13 of the container 10 may be attached with the bottom of the container body 20.

Figure 23:
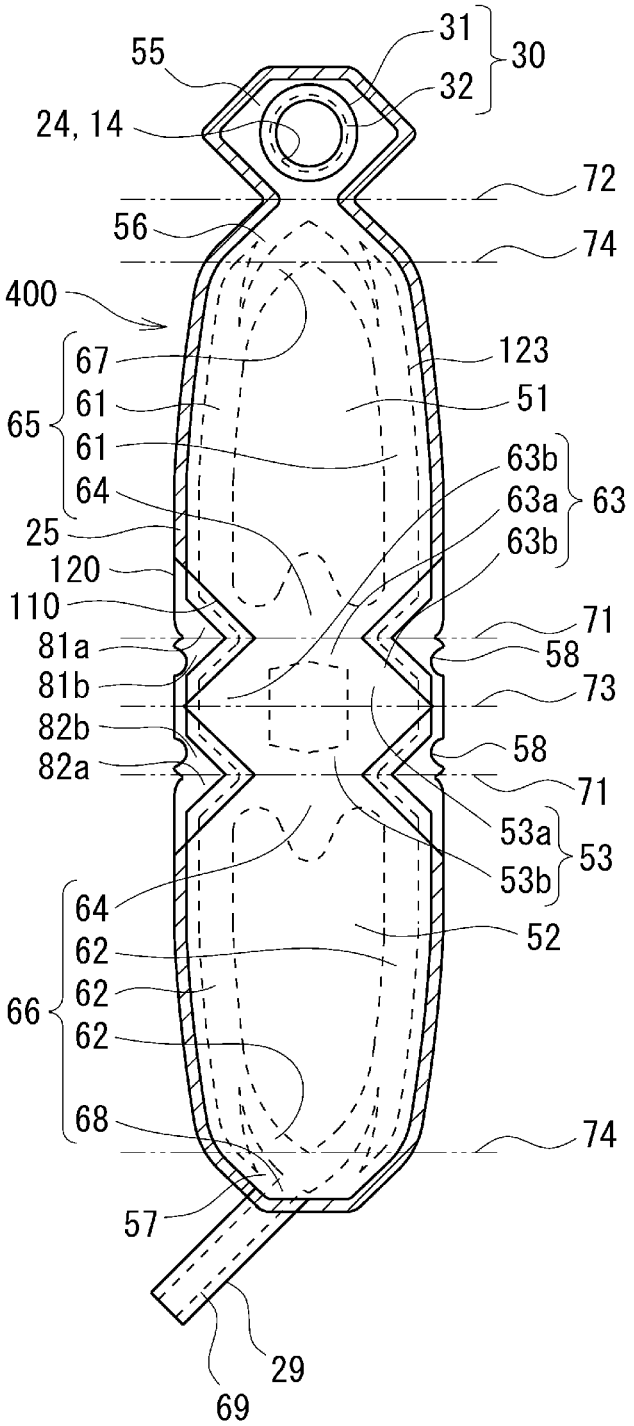
FIG. 23 is a plan view illustrating the container-forming sheet (with a spout) that composes the sheet container of the second embodiment, with a portion later formed into an accommodating area for accommodating an article directed to the top.
Figure 24:
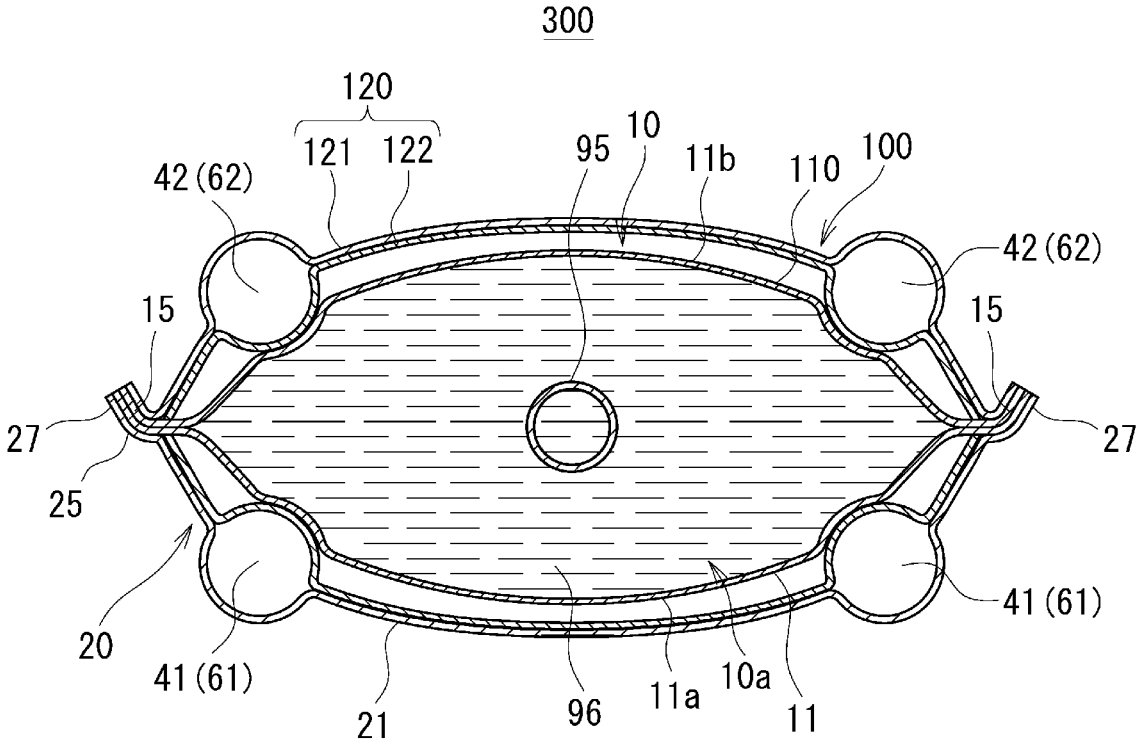
FIG. 24 is a cross-sectional view taken along line A-A in FIG. 18.

In order to obtain a structure in which the inner container sealed part 15 of the bottom gusset 13 is attached with the bottom of the container body 20, for example, in the container-forming sheet 400 (see FIG. 23), the inner container-forming sheet member 110 and the container body-forming sheet member 120 are made into the same shape, unlike in FIG. 23, the inner container-forming sheet member 110 and the container body-forming sheet member 120 are stacked while aligning the contour of the inner container-forming sheet member 110 and the contour of the container body-forming sheet member 120, and the circumferential part of the inner container-forming sheet member 110 and the circumferential part of the container body-forming sheet member 120 are mutually attached.

In this case, the inner container-forming sheet member 110 and the container body-forming sheet member 120 may be punched out using a common cutting blade, and this facilitates the manufacturing process of the sheet container 100.

If the inner container-forming sheet member 110 that composes the inner container 10 has a thickness not smaller than a certain level (for example, equals to or larger than 100 μm, and preferably equals to or larger than 120 μm), the inner container 10 may be suppressed from being lifted when sucked up by the pumping cap 90, even if the bottom of the inner container 10 is not interposed between the filled parts, or is not attached to the container body 20.

In the above description, the inner container 10 has the top gusset 12 and the container body 20 has the top gusset 22. However, the inner container 10 and the container body 20 may not have the top gusset 12 and the top gusset 22.

The cylinder part 32 of the spout 30, described in the embodiments above as having the pumping cap 90 attached thereto, may alternatively have a simple screw cap, dispenser or the like (trigger dispenser, for example) attached thereto.

The embodiments encompass the technical spirits below.

<1> A sheet container comprising a container body that surrounds an accommodating area for accommodating an article, the container body being composed of a sheet member given by lamination of a plurality of film layers, and comprising a front face, a rear face, and a bottom face, the sheet member comprising:

a front face-forming sheet part that forms the front face;

a rear face-forming sheet part that forms the rear face; and a bottom face-forming sheet part that forms the bottom face, at a side edge part of the container body, a side sealed part given by mutual attachment of side edge parts of the front face-forming sheet part and the rear face-forming sheet part, is formed to extend vertically, at the side edge part of the container body below the side sealed part, a front lower sheet tab and a rear lower sheet tab each of which is formed by a part of the sheet member is disposed, a front-rear sealed part given by mutual attachment of side edge parts of the front lower sheet tab and the rear lower sheet tab is formed, and, a skirt part given by integration of the front lower sheet tab and the rear lower sheet tab via the front-rear sealed part is formed, the skirt part being disposed at the side end of a bottom of the container body, an annular non-attached part in which the film layers are left partially unattached to each other is formed in the bottom face, an annular filled part is formed by enclosing a filler between the film layers at the annular non-attached part, a side part of the annular filled part is a side bulging part bulging toward the skirt part, the side bulging part presses a pressed part above the lower edge of the skirt part from the inside toward the sideward, the lower edge of the skirt part being disposed inwardly from the pressed part.

<2> The sheet container according to <1>, wherein, a lower end part of the skirt part at the central part thereof in the front-rear direction of the container body, is positioned above the bottom face.

<3> The sheet container according to <1> or <2>, wherein the front lower sheet tab is a front lower laminated part where a part of the front face-forming sheet part and a part of the bottom face-forming sheet part are overlapped with each other, and the rear lower sheet tab is a rear lower laminated part where a part of the rear face-forming sheet part and a part of the bottom face-forming sheet part are overlapped with each other.

<4> The sheet container according to <3>, wherein, in the front lower laminated part, the part of the front face-forming sheet part and the part of the bottom face-forming sheet part are mutually attached, and in the rear lower laminated part, the part of the rear face-forming sheet part and the part of the bottom face-forming sheet part are mutually attached.

<5> The sheet container according to any one of <1> to <4>, wherein at least a part of the front-rear sealed part is disposed below the pressed part.

<6> The sheet container according to <5>, wherein, in the front-rear sealed part, a lower end part of the front lower sheet tab and a lower end part of the rear lower sheet tab are locally attached.

<7> The sheet container according to any one of <1> to <6>, comprising:

a front non-attached part in which the film layers are left partially unattached to each other in the front face-forming sheet part;

a front filled part formed by enclosing a filler between the film layers in the front non-attached part;

a rear non-attached part in which the film layers are left partially unattached to each other in the rear face-forming sheet part; and a rear filled part formed by enclosing a filler between the film layers in the rear non-attached part, wherein, the front non-attached part and the rear non-attached part are communicate with the annular non-attached part at their lower end, and in a state that the sheet member is developed in a planar shape, each of a boundary part between the front non-attached part and the annular non-attached part, and a boundary part between the rear non-attached part and the annular non-attached part are constricted.

<8> The sheet container according to <7>, comprising:

a first peripheral non-attached part, where the film layers are left partially unattached to each other, disposed so as to extend vertically along at least one of both side edges of the front face;

a second peripheral non-attached part, where the film layers are left partially unattached to each other, disposed so as to extend vertically on the rear face at a place behind the first peripheral non-attached part; and a first peripheral filled part and a second peripheral filled part formed by enclosing a filler between the film layers in each of the first peripheral non-attached part and the second peripheral non-attached part, disposed so as to extend vertically, wherein, the front non-attached part comprises the first peripheral non-attached part, the rear non-attached part comprises the second peripheral non-attached part, the front filled part comprises the first peripheral filled part, the rear filled part comprises the second peripheral filled part, and the distance between the first peripheral filled part and the second peripheral filled part in the front-rear direction of the container body differs depending on the level of height in the vertical direction.

<9> The sheet container according to any one of <1> to <6>, comprising:

a first peripheral non-attached part, where the film layers are left partially unattached to each other, disposed so as to extend vertically along at least one of both side edges of the front face;

a second peripheral non-attached part, where the film layers are left partially unattached to each other, disposed so as to extend vertically on the rear face at a place behind the first peripheral non-attached part;

a first peripheral filled part and a second peripheral filled part formed by enclosing a filler between the film layers in each of the first peripheral non-attached part and the second peripheral non-attached part, disposed so as to extend vertically, wherein the distance between the first peripheral filled part and the second peripheral filled part in the front-rear direction of the container body differs depending on the level of height in the vertical direction.

<10> The sheet container according to <9> or <20>, wherein, in a partial area in the vertical direction of the container body, toward the upper side, the distance between the first peripheral filled part and the second peripheral filled part is, gradually widened and then gradually narrowed, and in the partial area, a portion between the first peripheral filled part and the second peripheral filled part is recessed inwardly.

<11> The sheet container according to <10>, wherein, the first peripheral filled part is disposed along each of both side edges of the front face, and in a front elevation, toward the upper side, the distance between the first peripheral filled parts in the partial area is gradually narrowed and then gradually widened.

<12> The sheet container according to <10> or <11>, wherein, in a lower area adjoining below the partial area of the container body, toward the lower side, the distance between the first peripheral filled part and the second peripheral filled part is gradually widened.

<13> The sheet container according to <12>, wherein the first peripheral filled part is disposed along each of both side edges of the front face, and in a front elevation, toward the lower side, the distance between the first peripheral filled parts in the lower area is gradually narrowed.

<14> The sheet container according to any one of <10> to <13>, wherein, in an upper area adjoining above the partial area of the container body, toward the upper side, the distance between the first peripheral filled part and the second peripheral filled part is gradually widened.

<15> The sheet container according to <14>, wherein the first peripheral filled part is disposed along each of both side edges of the front face, and in a front elevation, toward the upper side, the distance between the first peripheral filled parts in the upper area is gradually narrowed.

<16> The sheet container according to any one of <8> to <15> or <20>, further comprising an inner container composed of an inner container-forming sheet member with the circumferential parts thereof attached to each other, having the accommodating area, and being covered with the container body, wherein portions of an inner container sealed part, where the circumferential parts of the inner container-forming sheet member are mutually attached, are interposed individually between the side bulging part and the first peripheral filled part, and between the side bulging part and the second peripheral filled part.

<17> The sheet container according to <7>, further comprising an inner container composed of an inner container-forming sheet member with the circumferential parts thereof attached to each other, having the accommodating area, and being covered with the container body, wherein portions of an inner container sealed part, where the circumferential parts of the inner container-forming sheet member are mutually attached, are interposed individually between the side bulging part and the front filled part, and between the side bulging part and the rear filled part.

<18> A packed article in sheet container comprising:

the sheet container described in any one of <1> to <17> or <20>; and, an article accommodated in the accommodating area.

<19> A sheet for container comprising:

a container body that surrounds an accommodating area for accommodating an article, the container body being composed of a sheet member given by lamination of a plurality of film layers, the sheet member comprising:

a front face-forming sheet part that forms a front face of the container body;

a rear face-forming sheet part that forms a rear face of the container body; and a bottom face-forming sheet part that forms a bottom face of the container body, at a side edge part of the container body, a side sealed part given by mutual attachment of side edge parts of the front face-forming sheet part and the rear face-forming sheet part, is formed to extend vertically, at the side edge part of the container body below the side sealed part, a front lower sheet tab and a rear lower sheet tab each of which is formed by a part of the sheet member is disposed, a front-rear sealed part given by mutual attachment of side edge parts of the front lower sheet tab and the rear lower sheet tab is formed, and, a skirt part given by integration of the front lower sheet tab and the rear lower sheet tab via the front-rear sealed part is formed, the bottom face-forming sheet part is formed with an non-attached part where the film layers are left partially unattached to each other, and, when a filler is enclosed between the film layers in the non-attached part of the bottom face-forming sheet part, the container body will be given a shape with the front face, the rear face, and the bottom face, the bottom face will have formed therein an annular filled part filled with the filler, the skirt part will be disposed at the side end of a bottom of the container body, a side part of the annular filled part will be a side bulging part bulging toward the skirt part, the side bulging part will press a pressed part above the lower edge of the skirt part from the inside toward the sideward, the lower edge of the skirt part will be disposed inwardly from the pressed part.

<20> A container-forming sheet comprising a sheet member composing a container body, given by lamination of a plurality of film layers, the sheet member comprising an annular non-attached part where a plurality of film layers are left partially unattached to each other, the sheet member comprising:

a front face-forming sheet part that forms a front face of the container body;

a rear face-forming sheet part that forms a rear face of the container body; and a bottom face-forming sheet part that forms a bottom face of the container body, and, when the container body is formed by folding the sheet member, and by enclosing a filler between the plurality of film layers in the non-attached part to form an annular filled part, the container body will be given a shape with the front face, the rear face, and the bottom face, at a side edge part of the container body, a side sealed part given by mutual attachment of side edge parts of the front face-forming sheet part and the rear face-forming sheet part, will be formed to extend vertically, at the side edge part of the container body below the side sealed part, a front lower sheet tab and a rear lower sheet tab each of which is formed by a part of the sheet member will be disposed, a front-rear sealed part given by mutual attachment of side edge parts of the front lower sheet tab and the rear lower sheet tab will be formed, and, a skirt part given by integration of the front lower sheet tab and the rear lower sheet tab via the front-rear sealed part will be formed, the skirt part will be disposed at the side end of a bottom of the container body, the annular filled part will be disposed at the bottom, a side part of the annular filled part will be a side bulging part bulging toward the skirt part, the side bulging part will press a pressed part above the lower edge of the skirt part from the inside toward the sideward, and the lower edge of the skirt part will be disposed inwardly from the pressed part.

<21> A sheet container comprising a container body that surrounds an accommodating area for accommodating an article, the container body being composed of a sheet member given by lamination of a plurality of film layers, and comprising a front face, a rear face, and a bottom face, the sheet member comprising:

a front face-forming sheet part that forms the front face;

a rear face-forming sheet part that forms the rear face; and a bottom face-forming sheet part that forms the bottom face, a first peripheral non-attached part, where the film layers are left partially unattached to each other, disposed so as to extend vertically along at least one of both side edges of the front face;

a second peripheral non-attached part, where the film layers are left partially unattached to each other, disposed so as to extend vertically on the rear face at a place behind the first peripheral non-attached part;

a first peripheral filled part and a second peripheral filled part formed by enclosing a filler between the film layers in each of the first peripheral non-attached part and the second peripheral non-attached part, disposed so as to extend vertically; and the distance between the first peripheral filled part and the second peripheral filled part in the front-rear direction of the container body differing depending on the level of height in the vertical direction.

EXPLANATION OF REFERENCE CHARACTERS

10 inner container
10*a* accommodating area
11 trunk
11*a* front face
11*b* rear face
12 top gusset
13 bottom gusset
14 opening
15 inner container sealed part
15*a* bottom gusset peripheral sealed part
20 container body
20*a* accommodating area
21 trunk (container body trunk)
21*a* front face
21*b* rear face
22 top gusset
23 bottom gusset (bottom face)
23*a* raised part
24 opening
24*a* opening
25 interior/exterior sealed part
26 seal
27 side sealed part
27*a*, 27*b* side
271 sealed part
28 bottom
29 filler introducing part
30 spout
31 base
32 cylinder part
41 first peripheral filled part
41*a* lower part
42 second peripheral filled part
42*a* lower part
43 annular filled part (annular filled part)
43*a* annular part
43*b* side bulging part
44 lower transverse direction filled part
45 front filled part
46 rear filled part
47 upper transverse direction filled part
48 filled part
49 filled part
51 front face-forming sheet part
52 rear face-forming sheet part
53 bottom face-forming sheet part
53*a* front part
53*b* rear part
55 top gusset sheet part
56 top gusset attaching part
57 top gusset attaching part
58 notched part
61 first peripheral non-attached part
62 second peripheral non-attached part
63 annular non-attached part (annular non-attached part)
63*a* annular part
63*b* side projected part
64 lower transverse direction non-attached part
65 front non-attached part
66 rear non-attached part
67 upper transverse direction non-attached part
68 non-attached part
69 non-attached part
71 folding line
72 folding line
73 folding line
74 folding line
80 skirt part
80*a* pressed part
80*b* bottom edge
80*c* central part
81 front lower sheet tab
81*a* outer tab
81*b* inner tab
82 rear lower sheet tab
82*a* outer tab
82*b* inner tab
83 front-rear sealed part
84 attaching part
90 pumping cap
91 cap
92 upright cylinder
93 depressable part
94 nozzle
95 liquid feeding tube
96 article
100 sheet container
110 inner container-forming sheet member
111 inner surface
112 outer surface
117*a* introducing part-forming part
120 container body-forming sheet member (sheet member)
121 first film layer
122 second film layer
123 non-attached part
131 first layer
132 second layer
133 third layer
141 first layer
142 second layer
143 third layer
143 fourth layer
151 boundary part
152 boundary part
161 partial area
162 lower area
163 upper area
171 recess

200 sheet for container
300 packed article in sheet container
400 container-forming sheet

The invention claimed is:

1. A sheet container, comprising:

a container body that surrounds an accommodating area for accommodating an article, the container body being composed of a sheet member given by lamination of a plurality of film layers, the container body comprising a front face, a rear face, a bottom face, and a top gusset including an opening through which the article can be discharged, the sheet member comprising:

a front face-forming sheet part that forms the front face;

a rear face-forming sheet part that forms the rear face; and a bottom face-forming sheet part that forms the bottom face; and a top gusset sheet part that forms the top gusset, at a side edge part of the container body, a side sealed part given by mutual attachment of side edge parts of the front face-forming sheet part and the rear face-forming sheet part, is formed to extend vertically, the top gusset is surrounded by a first sealed part and a second sealed part, the first sealed part is given by mutual attachment of the front face-forming sheet part and the top gusset sheet part, the second sealed part is given by mutual attachment of the rear face-forming sheet part and the top gusset sheet part, along both side edges of the front face-forming sheet part, a first peripheral non-attached part, where the film layers are left partially unattached to each other, is disposed so as to extend vertically, along both side edges of the rear face-forming sheet part, a second peripheral non-attached part, where the film layers are left partially unattached to each other, is disposed so as to extend vertically, a first peripheral filled part extending vertically is formed by enclosing a filler between the film layers at each of the first peripheral non-attached parts, a second peripheral filled part extending vertically is formed by enclosing a filler between the film layers at each of the second peripheral non-attached parts, in an upper area of the container body, a distance between the first peripheral filled part and the second peripheral filled part is gradually widened toward an upper side of the sheet container, in the upper area of the container body, the first peripheral filled part extends along the first sealed part, and in the upper area of the container body, the second peripheral filled part extends along the second sealed part.

* * * * *